US011615773B1

(12) United States Patent
Campbell

(10) Patent No.: US 11,615,773 B1
(45) Date of Patent: Mar. 28, 2023

(54) STRING SUSTAINER FOR MUSICAL INSTRUMENT

(71) Applicant: Merkaba Electronics LLC, Austin, TX (US)

(72) Inventor: Stuart R. Campbell, Smithville, TX (US)

( * ) Notice: Subject to any disclaimer, the term of this patent is extended or adjusted under 35 U.S.C. 154(b) by 301 days.

(21) Appl. No.: 16/894,335

(22) Filed: Jun. 5, 2020

Related U.S. Application Data

(60) Provisional application No. 62/858,066, filed on Jun. 6, 2019.

(51) Int. Cl.
*G10H 3/26* (2006.01)
*G10H 3/18* (2006.01)

(52) U.S. Cl.
CPC ..... *G10H 3/26* (2013.01); *G10H 3/18* (2013.01)

(58) Field of Classification Search
CPC ..... G10H 3/26; G10H 3/18
USPC ..... 84/726
See application file for complete search history.

(56) References Cited

U.S. PATENT DOCUMENTS 2,968,204 A * 1/1961 Fender ..... G10H 3/181 984/368
3,677,124 A * 7/1972 O'Brien ..... G10C 1/06 984/54
3,962,946 A * 6/1976 Rickard ..... G10H 3/182 984/369
4,075,921 A * 2/1978 Heet ..... G10H 3/26 84/738
D248,122 S 6/1978 Heet
4,348,930 A * 9/1982 Chobanian ..... G10H 3/182 984/369
4,852,444 A * 8/1989 Hoover ..... G10H 3/26 84/738
4,947,726 A * 8/1990 Takabayashi ..... G10H 3/18 84/723
5,214,232 A * 5/1993 Iijima ..... G10H 3/181 84/723
5,585,588 A * 12/1996 Tumura ..... G10H 3/26 84/738

(Continued)

FOREIGN PATENT DOCUMENTS

CA 2802549 A1 * 12/2011 ..... G10H 1/0551
JP H05119775 A * 5/1993

(Continued)

OTHER PUBLICATIONS

The Amazing EBow. Website [online]. Heet Sound Products, 2020, [retrieved on Aug. 14, 2020]. Retrieved from < https://ebow.com/home.php>.

(Continued)

*Primary Examiner* — Christina M Schreiber
(74) *Attorney, Agent, or Firm* — Frost Brown Todd LLP

(57) ABSTRACT

A sustainer is described for use with resonant strings in instruments like guitars, bases, slide guitars and others. Described sustainers can be handheld or integrated into an instrument. Sustainers under the current disclosure can include an approaching or direction detector that detects movement of a resonant element towards or away from the sustainer. Depending on the movement a signal can be fed to an output actuator that creates a magnetic field to sustain or otherwise interact with the resonance of the element.

7 Claims, 27 Drawing Sheets

(56) References Cited

U.S. PATENT DOCUMENTS

| | | | | |
|---|---|---|---|---|
| 5,932,827 | A * | 8/1999 | Osborne | G10H 3/18 84/738 |
| 6,034,316 | A * | 3/2000 | Hoover | G10H 3/26 84/738 |
| 6,201,172 | B1 * | 3/2001 | Denton | G10D 3/153 84/313 |
| 10,482,859 | B1 * | 11/2019 | Horban | G10H 3/182 |
| 2006/0150806 | A1 * | 7/2006 | Hara | G10H 3/182 84/726 |
| 2014/0076127 | A1 * | 3/2014 | Haddad | G10H 3/18 84/724 |
| 2016/0049142 | A1 * | 2/2016 | Radmacher | G10H 3/181 84/726 |
| 2016/0217778 | A1 * | 7/2016 | Iermenko | G10H 3/186 |
| 2021/0287640 | A1 * | 9/2021 | Gilmore | G10H 1/44 |

FOREIGN PATENT DOCUMENTS

| | | | |
|---|---|---|---|
| JP | H05341789 | A * | 12/1993 |
| JP | 3086825 | B2 * | 9/2000 |

OTHER PUBLICATIONS

Screen captures from YouTube video clip entitled "EBOW—Demo, Review & Tips—Phil Keaggy Inspired Ebow Plus," 4 pages, uploaded on Jun. 7, 2012 by Nail Guitar Skills. Retrieved from the Internet, <https://www.youtube.com/watch?v=4oSX1B2Q4us> on Aug. 14, 2020.

TC Electronic | Product | Aeon. Website [online]. Music Tribe Global Brands Ltd., 2020 [retrieved on Aug. 14, 2020], Retrieved from the Internet, <https://www.tcelectronic.com/product.html?modelCode=P0DAS#googtrans(enlen)>.

Screen captures from YouTube video clip entitled "TC Electronic Aeon String Sustainer Review", 2 pages, uploaded on Sep. 27, 2018 by EytschPi42. Retrieved from the Internet, <https//ww.youtube.com/watch?v=91MoMXLN4xU&t=284s> on Aug. 26, 2020.

The Wond II Project: EMpick. Website [online]. VoInventions LLC, 2020 [retrieved on Aug. 26, 2020], Retrieved from <https:voinventions.com/wond-ii-proiect/>.

Screen captures from YouTube video clip entitled "Paul Vo Introduces the Vo Wand, 2015 NAMM Show", 2 pages, uploaded on Jan. 27, 2015 by Synthtopia. Retrieved from the Internet: <https://www.youtube.com/watch?v=DN_dB55YLKU>on Aug. 26, 2020.

* cited by examiner

STRING SUSTAINER FOR MUSICAL INSTRUMENT

CROSS REFERENCE TO RELATED INFORMATION

This application claims the benefit of U.S. Provisional Patent Application No. 62/858,066, filed Jun. 6, 2019, titled String Sustainer for Musical Instrument, the contents of which are hereby incorporated herein in its entirety.

TECHNICAL FIELD

The present disclosure is directed to sustainers for stringed instruments or instruments with resonant elements.

BACKGROUND OF THE INVENTION

String sustainers or guitar sustainers are devices that use magnetic fields to initiate and or continue the vibration of a metal string such as those used in guitars. Hand-held sustainers are held over the string or strings to be vibrated and generate magnetic fields that sustain the vibration of the string. Instrument mounted devices may be placed in the body of the instrument. The devices can also be used to initiate the string vibration. Sustainers can be useful for guitars, base guitars, slide guitars and other instruments.

BRIEF SUMMARY OF THE INVENTION

One embodiment under the present disclosure comprises a sustainer for a stringed instrument. The sustainer comprises a direction detector configured to generate an electrical signal in the presence of a string; and an output actuator coupled to the direction detector and configured to generate, in response to the electrical signal, a magnetic field that impacts the resonance of the string.

Another embodiment under the present disclosure comprises a stringed instrument. The stringed instrument comprises a resonant string; a direction detector configured to generate an electrical signal in response to movement of the resonant string, the electrical signal signifying movement away from or toward the direction detector; and an output actuator electrically coupled to the direction detector and configured to, in response to the electrical signal, generate an output magnetic field for sustaining the movement of the string when it is moving toward the direction detector.

Another embodiment under the present disclosure comprises a method of sustaining a resonant element of an instrument. The method comprises: detecting a movement of the resonant element by induction of a current in a direction detector; transmitting the current to an operational amplifier; using the operational amplifier to compare the current to an input; transmitting an output of the operational amplifier to an output actuator; and allowing the output actuator to generate a magnetic field in response to the output, the magnetic field configured to sustain the movement of the resonant element when the resonant element is moving towards the pickup.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Teachings under the present disclosure include string and guitar sustainers and various embodiments thereof. Benefits of the present disclosure include greater power efficiency and savings, unique sound characteristics, and greater control over sound quality and effects during the use of stringed instruments, including guitars, base guitars, slide guitars and other instruments.

Figure 1:
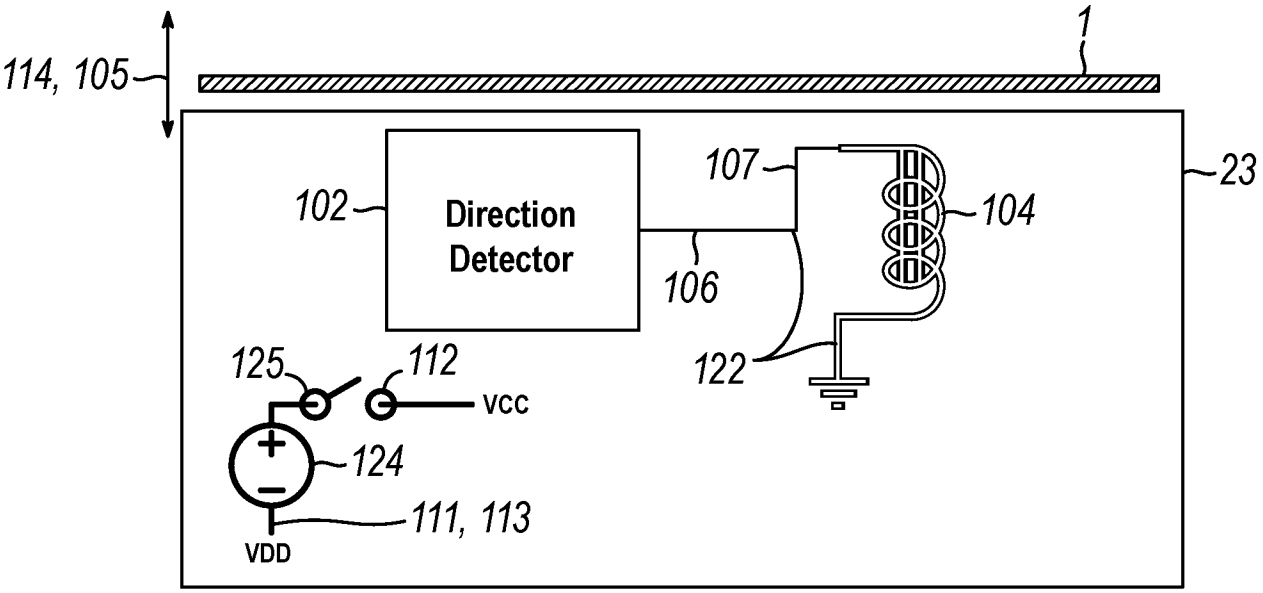
FIG. 1 is an embodiment of a sustainer under the present disclosure.

FIG. 1 shows one possible embodiment of a string sustainer according to the concepts described herein. The initiator/sustainer system 23 can include: a power source 124 (preferably DC or battery), a means for enabling or disabling power to the device (such as a switch 125), a direction detector 102, an output actuator 104, an output from direction detector 106, and an input to output actuator 107. As described below, direction detector 102 can be adjusted to detect approaching resonant elements or receding resonant elements. In general, direction detector 102 can detect movement of resonant elements. The initiator/sustainer system 23 will be used to initiate and sustain string or resonant member 1. When the sustainer 23 is moved towards 105 string or resonant member 1, direction detector 102 senses that the string or resonant member 1 is moving closer to the sustainer 23 and outputs a voltage. In this embodiment the output voltage can be nearly equal to that of VCC 112 as compared to common reference point 111 across output line 106, which feeds to input line 107 of output actuator 104. But such output voltage could be adjusted in other embodiments. This voltage results in a current across output actuator 104 which results in an increased magnetic field near string or resonant member 1 which acts to attract string or resonant member towards sustainer 23. When string or resonant member 1 moves away 114 from sustainer 23, direction detector 102 outputs a different voltage. In this embodiment the "moving away" voltage is nearly equivalent to VDD of the common reference point 111 or 113, relative to common reference point 111. This could be varied depending on embodiment and user preference. This alteration between switching on and off depending on whether or not the string or resonant member 1 is approaching or not leads to the initiation and sustainment of oscillations in string or resonant member 1.

Figure 2A:
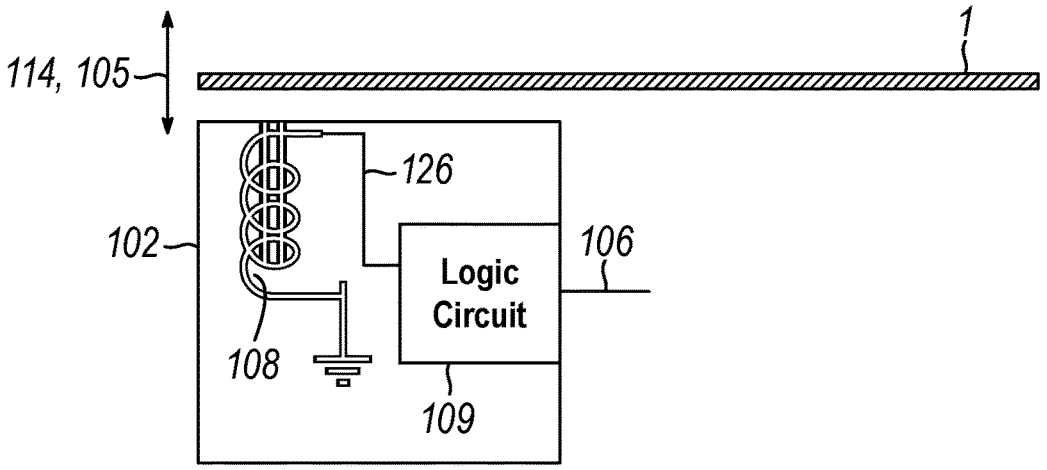
FIGS. 2A-2B are embodiments of direction detectors under the present disclosure.

FIG. 2A shows one embodiment of direction detector 102 from FIG. 1. Direction detector 102 can comprise pickup or signal transducer 108, logic circuit 109 (ADC, Threshold Switch, Comparator (Ground or ½ VCC referenced), or zero crossing), a connection 126 between pickup and logic circuit 109, and an output 106 from direction detector 102. When string or resonant member 1 is moving towards direction detector 102, whether by moving the direction detector 102 closer to the string, or through oscillation in the string 114, pickup 108 outputs a signal voltage that is positive relative to ground over connection 126. The logic circuit 109 compares this signal to ground and, if millivolts higher (or a suitably biased range) can output a voltage near or at VCC, a.k.a "1", on direction detector output 106. When the sustainer device 23 and string or resonant member 1 are moving away from each other, the voltage of pickup 108 will become negative relative to ground and the output from logic circuit 109 will go to ground, a.k.a "0". If the sustainer 23 and the string or resonant member 1 are not moving relative to each other, logic circuit 109 can go to or remain at ground. Other embodiments, described below, include an output of greater than zero when the sustainer 23 and resonant member 1 are not moving closer or further away from each other.

Figure 2B:
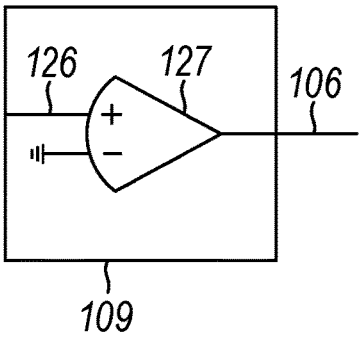

In FIG. 2B one embodiment of logic circuit 109 is shown with an operational amplifier 127 configured to be a ground referenced comparator. In this embodiment, connection 126 (the output from pickup 108) connects to operational amplifier/comparator 127 within logic circuit 109. The comparison is made to ground, and the output is output 106 from FIG. 1. Operational amplifier 127 could comprise a 1-bit flash ADC, but other configurations are possible.

Logic circuit 109 could use a variety of means of threshold switching so as to vary the output of the direction detector 102, depending on a user's preferences. For example, the output when the detector 102 and resonant string 1 are stationary, or at least initially stationary, can be varied. One embodiment could lead to Table 1.

TABLE 1

| Approach Detector Output | |
|---|---|
| No movement of string relative to detector | 0 |
| String moving away from detector | 0 |
| String moving towards detector | 1 |

Other embodiments could utilize Table 2. Most embodiments will output 0 when the string 1 and detector 102 are moving away from each other. Most embodiments will output 1 when the string 1 and detector 102 are moving toward each other. What output to give when the components are stationary is more likely to vary depending on user preference.

TABLE 2

| Approach Detector Output | |
|---|---|
| No movement of string relative to detector | 1 |
| String moving away from detector | 0 |
| String moving towards detector | 1 |

The most common method of modifying the output when the components are stationary may be to change the logic circuit 109. But other means of modifying the output can be used, including as discussed further below. Embodiments using the output of Table 2 can create sound quicker, even when there's no initial movement or resonance of a string. Embodiments under Table 2 may necessitate unique chip circuitry that is not commonly used or available.

Figure 3:
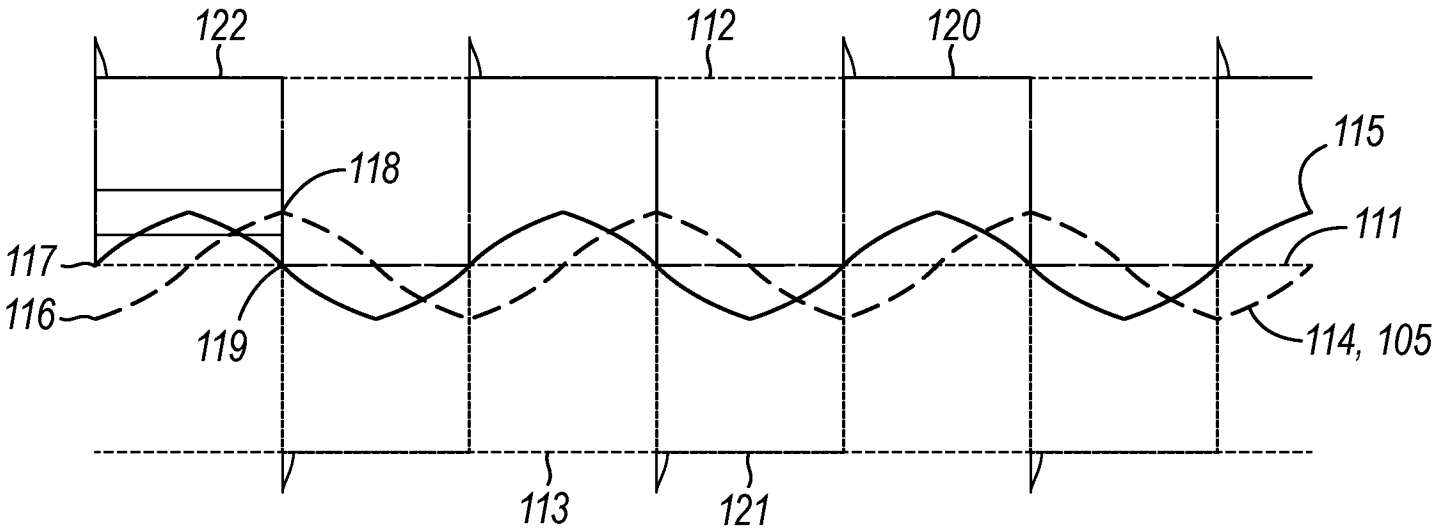
FIG. 3 shows a waveform embodiment of sound under the present disclosure.

FIG. 3 shows examples of possible various waveforms relevant to the functioning a sustainer 23 under the present disclosure. In this embodiment, a common reference point 111 is tied to either VDD or ½ VCC depending on the specific embodiment of the device. VCC of DC power supply is represented by line 112. Depending on the specific embodiment of the device line 113 shows either VDD or −VCC. Movement of the string or resonant member 1 relative to the sustainer 23 is shown by waveform 114 or 105. The output voltage from pickup 108 of direction detector 102 is represented by waveform 115. The voltage across output actuator 104 is represented by waveform 122. The voltage from direction detector 102 is represented by waveforms 120 or 121 depending on the embodiment of the device. Waveform 120 represents an embodiment where reference point 111 is also VDD, and reference point 113 is equal to −VCC. Waveform 120 represents an embodiment where reference point 111 is ½ VCC, and reference point 113 is VDD. In both waveforms 120 and 121 line 112 is representative of VCC of DC power supply 124, and lead to a similar voltage across output actuator 104 as represented by waveform 122. Between points 116 and 118, the string or resonant member is approaching the device 23. At point 118 the string begins moving away from the direction detector. As the approach begins 116 the voltage on pickup 108 (in direction detector 102) goes above reference point 111 (represented by point 117) and goes below reference point 111 (represented by point 119) on waveform 115. As a result, the direction detector output 120 or 121 goes to VCC 112. Section 120 represents the direction detector output signal where VDD and ground are equivalent. Section 121 represents the direction detector output signal where common reference is equivalent to ½ VCC.

This change in voltage across output actuator 104 results in an attractive force that initiates or sustains movement towards the device. When the string or resonant member begins moving away 118, by natural resonant forces, the voltage on pickup 108 in direction detector 102 goes below reference point 111, and the direction detector output 120 or 121 goes to VDD, which may be either 112 or 111 depending on the embodiment. This leads to waveform 122 going negative compared to reference point 111 which represents a large change in voltage across output actuator 104, which, depending on configuration, results in a repulsive magnetic force or a relaxation of magnetic force on string or resonant member, 1. Using this system, a string or resonant member can be set into oscillation, and have those oscillations sustained.

Figure 4:
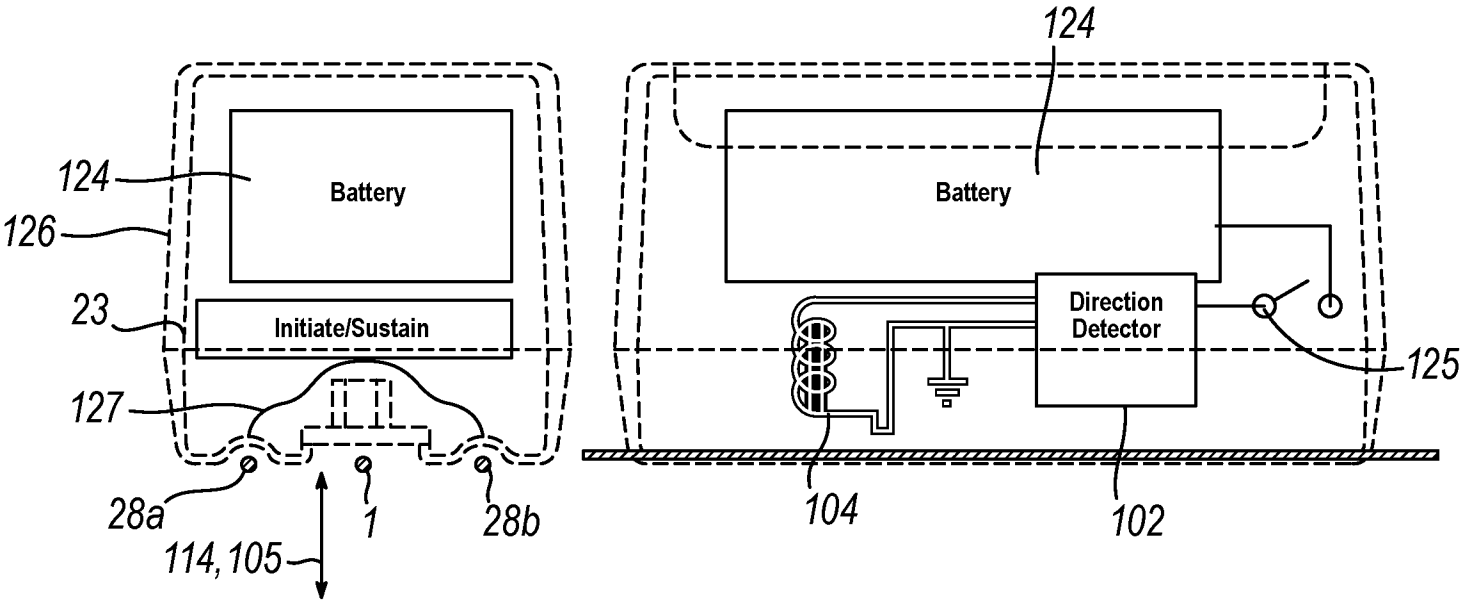
FIG. 4 shows an embodiment of a handheld sustainer under the present disclosure.

FIG. 4 depicts an embodiment of an exemplary layout for a handheld iteration of the device. The housing 126 for the device 26 is preferably made from multiple pieces of injection molded plastic, consisting of a means of mounting a printed circuit board, holding and concealing a battery, and allowing for proper positioning on a musical instrument. The initiate/Sustain system 23 is mounted inside housing 126, powered by a battery 124 (or DC power source), and controlled by On/Off switch 125. An indicator light may also be placed on the device. When the device is placed on a musical instrument with multiple parallel strings, the strings parallel 28*a* and 28*b* or adjacent to the string that is desired to oscillate 1, are designed to be placed in guide grooves 127. This allows the string that is desired to oscillate 1 to be centered underneath the direction detector 102 and output actuator 104. The action of placing the device 23 on a set of parallel strings causes movement of string or device relative to each other which induces and/or sustains oscillations in string 1. Parallel strings 28*a* and 28*b* resting in guide grooves 127, help to position the device for both proper operation, and ease of use. After the device is placed on the instrument, if oscillations cease, the user can manipulate the device so as to cause movement of string and device relative to each other 115, thus inducing oscillations. Device can be modified to fit over more or fewer strings as desired. Movement of string 1 and device 23 relative to each other can be toward 105 or away 114.

Figure 5:
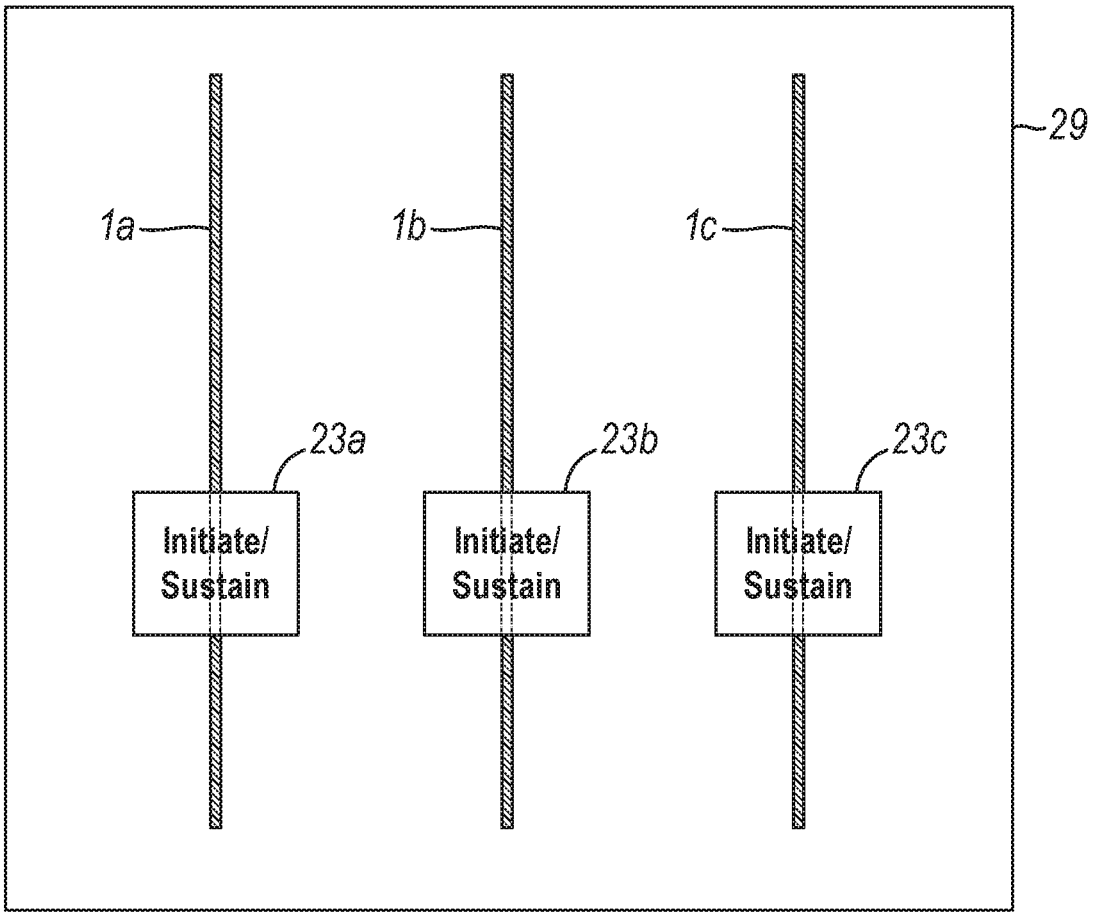
FIG. 5 shows an embodiment of sustainers under the present disclosure.

FIG. 5 Shows an embodiment of a general layout for an instrument mounted version of this device. The initiate/sustain system could be permanently or temporarily fixed to the body of a musical instrument 29. This could be done for a single string or a number of strings. For simplicity, only three strings are shown in this illustration. Initiate/Sustain Systems 23*a*, 23*b*, and 23*c*, are mounted in a suitable manner to the musical instrument body 29, placed adjacent to strings 1*a*, 1*b*, and 1*c* respectively. The devices could be configured to activate all at once or be controlled individually as in one current iteration of the device. One limitation to some configurations is that some sort of physical force must be placed on the string in order to initiate vibration or relative movement of some sort between string and sustainer. In one embodiment, this is achieved by use of a mounted moveable slide mechanism. It would be possible to add a system to cause the initiate/sustain systems 23*a*, 23*b*, and 23*c* to move towards a string when desired by use of mechanical means. Many different sounds could be produced depending on how this mechanism would be implemented. One possibility would be a device that would move the initiate/sustain systems 23*a*, 23*b*, and 23*c* in an oscillating manner. This would result in a tremolo effect. It would also be possible to use a muting device that would result in a "hammer-off" effect on the string that is being activated, thus resulting in an initiation of oscillations.

Figure 6:
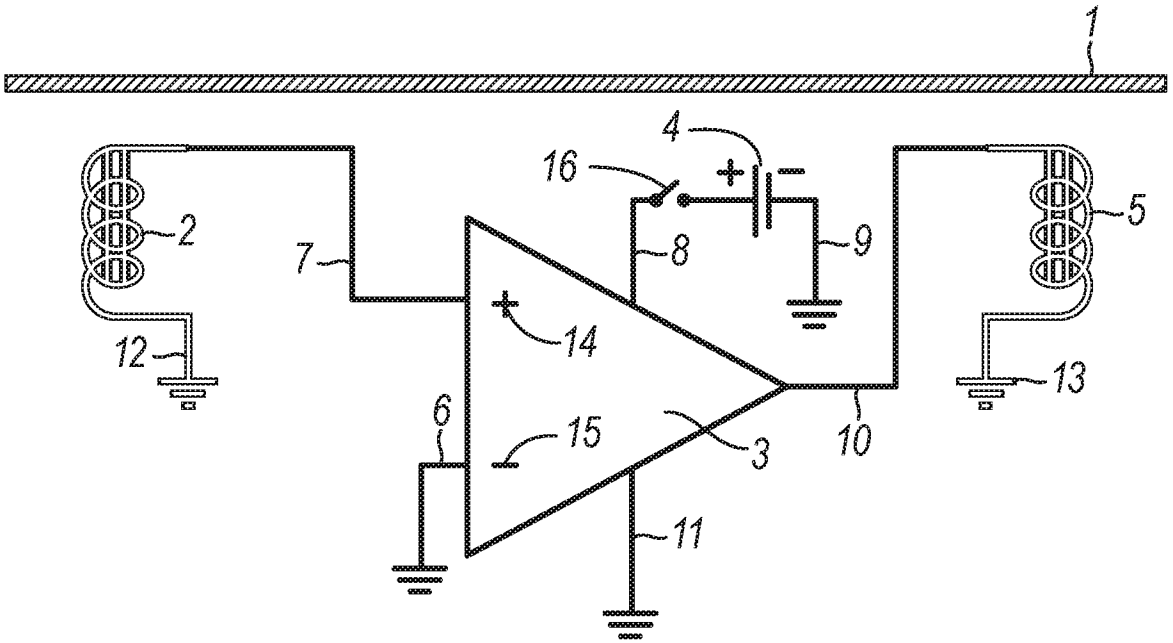
FIG. 6 shows an embodiment of sustainer circuitry under the present disclosure.
Figure 7:
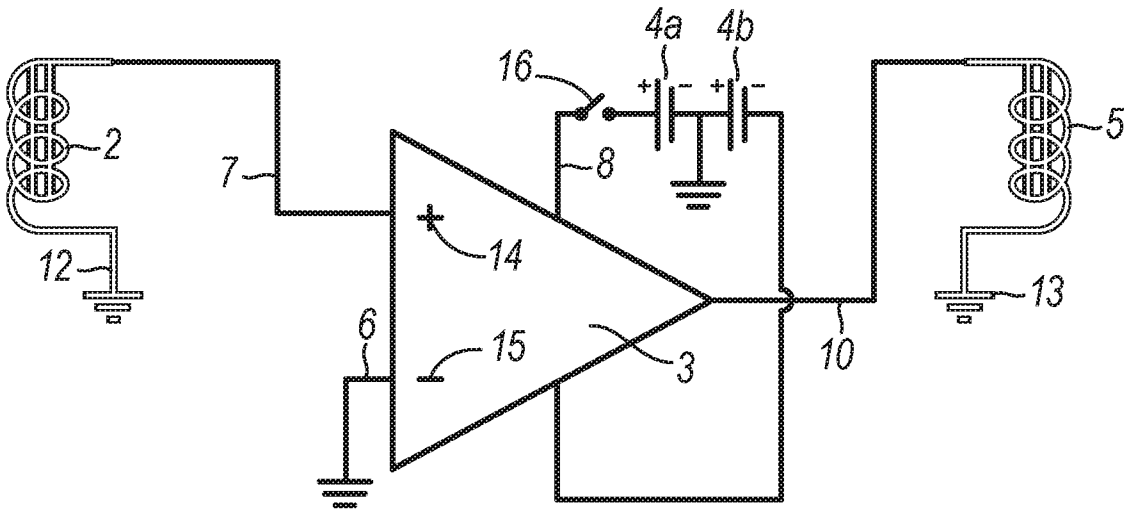
FIG. 7 shows an embodiment of sustainer circuitry under the present disclosure.
Figure 8:
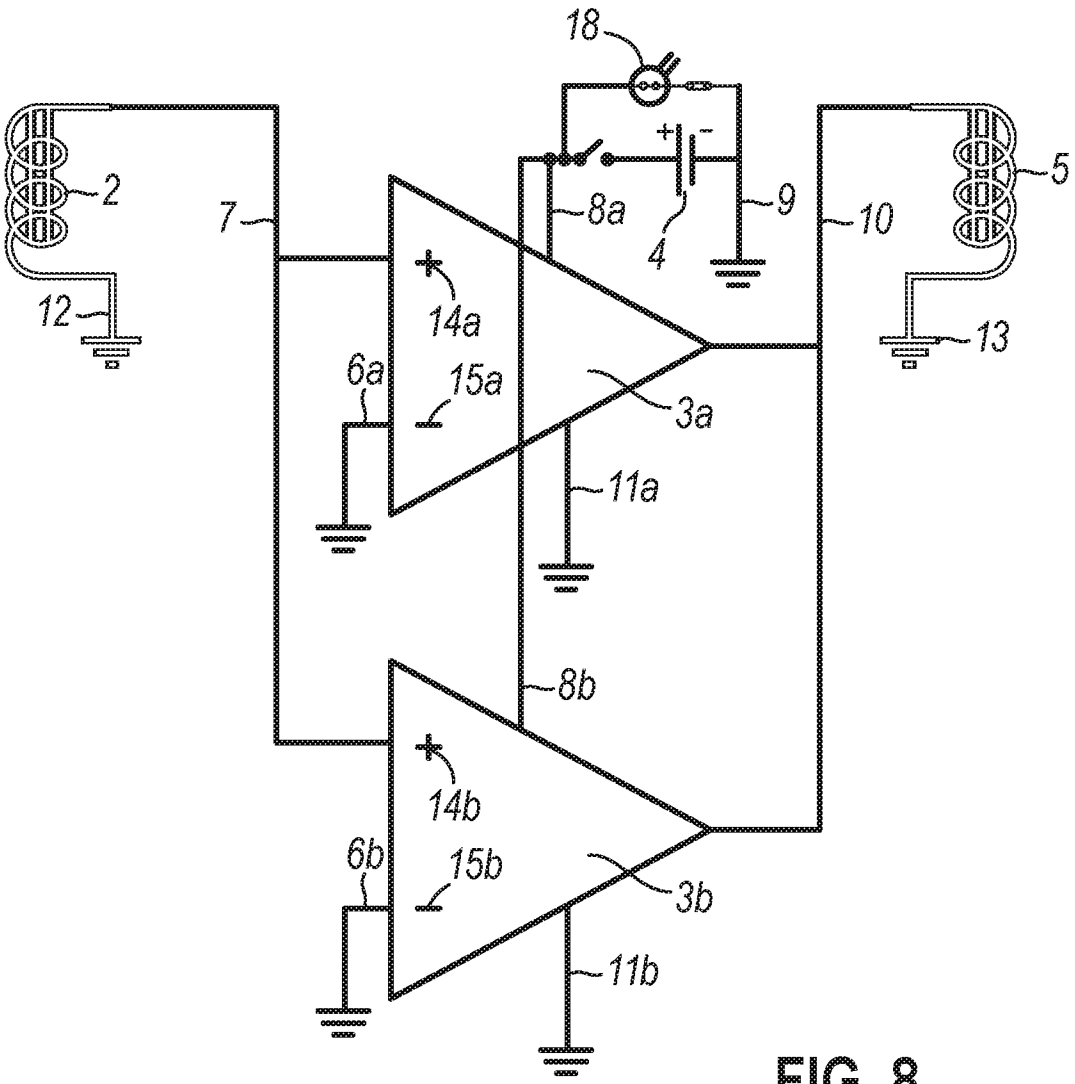
FIG. 8 shows an embodiment of sustainer circuitry under the present disclosure.

FIGS. 6 through 8 show alternate embodiments of circuits under the present disclosure.

FIG. 6 shows an operational amplifier used for the logic portion of the direction detector with a single power source. The embodiment of FIG. 6 comprises a direction detector 2, string 1, ground 12, common ground or ground signal 6, and detector signal 7. Operational amplifier 3 receives detector output 7 at a noninverting input 14. Operational amplifier 3 also receives an inverting input 15 from inverting input ground reference 6. Operational amplifier 3 also has an operational amplifier ground 11 and a DC power source 4. Power source 4 comprises DC power/common ground 9, on/off switch 16, and provides power to operational amplifier 3 via connection 8. Output 10 provides a signal to output magnet coil 5 which is then imparted to string 1 via a magnetic field. Output magnet coil 5 also comprises output magnet coil ground 13.

FIG. 7 shows a configuration similar to FIG. 6, however, a dual rail power source is used for this configuration. The various components such as the direction detector 2, various inputs, and output magnet coil 5 are the same as FIG. 6. However, FIG. 7 displays two power sources 4*a* and 4*b* each coupled to switch 16, connection 8, and operational amplifier 3. Output 10 provides a signal to output magnet coil 5 which then imparts a signal to string 1 (not shown). When in use, the presence of two power sources allows the embodiment of FIG. 7 to reverse polarity easier, allowing a related waveform to go negative as well as positive. This can impart a different sound and behavior on any strings 1 than other embodiments.

The embodiment of FIG. 8 shows two operational amplifiers 3*a* and 3*b* configured in parallel with an indicator light 18 present. The various components such as the direction detector 2 and output magnet coil 5 are similar to FIG. 6. However, FIG. 7 displays two power operational amplifiers 3*a* and 3*b*, each coupled to switch 16 by connections 8*a* and 8*b*. Operational amplifiers 3*a* and 3*b* respectively comprise noninverting inputs 14*a*, 14*b*, inverting inputs 15*a*, 15*b*, connections to inverting input ground reference 6*a*, 6*b*, and operational amplifier grounds 11*a*, 11*b*. Indicator light 18 can indicate whether power is on or not. This embodiment can allow for more current to the output magnet coil 5 without hurting any comprising chip.

These FIGS. 6-8 could borrow configurations from each other, i.e. indicator lamp, parallel configuration, dual rail power supply, etc.

Figure 9:
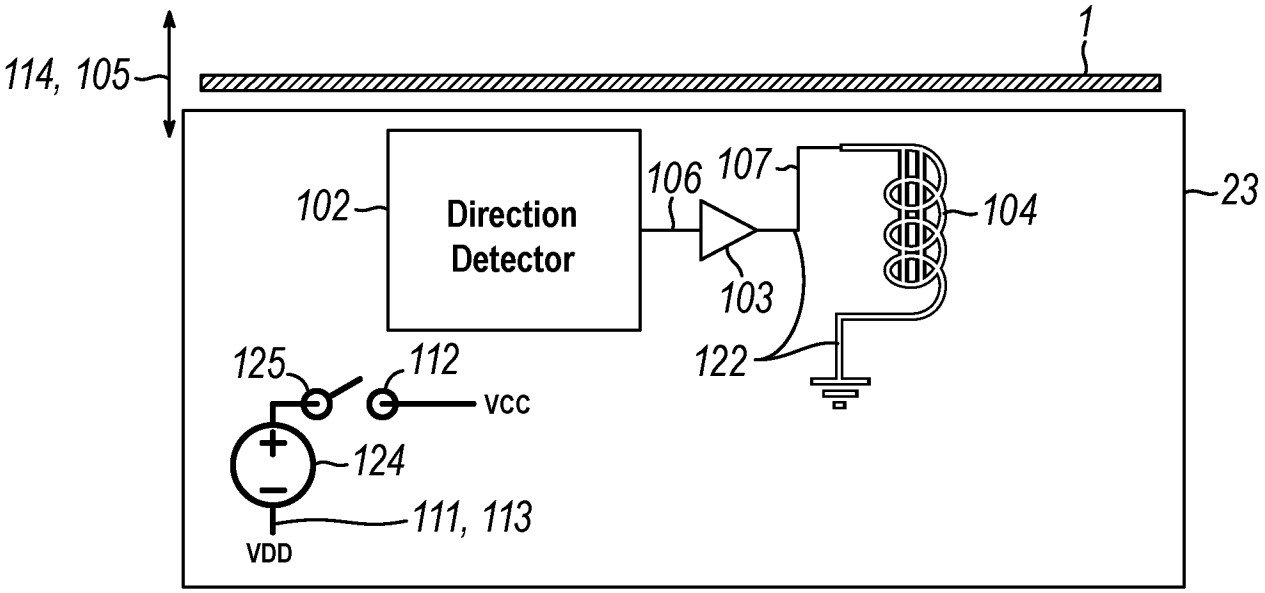
FIG. 9 shows an embodiment of sustainer circuitry under the present disclosure.

FIG. 9 shows another embodiment that is similar to FIG. 1. In this embodiment the components of sustainer 23 such as direction detector 102 and output actuator 104 are the same as FIG. 1. However, in FIG. 9 between output 106 and input 107 there is an additional component 103. Component 103 can comprise a buffer, resistor, an opto-coupler, or other component. A preferred embodiment, such as in FIG. 1, comprises no component 103, but such components can be used. A buffer may be used to protect the circuitry of output actuator 104 or to restrict or provide resistance of current. An opto-coupler can be used in some embodiments to assist in noise reduction. An opto-coupler can comprise a light emitting diode (LED) on an input side of the opto-coupler and a light sensitive diode on an output side of the opto-coupler. Between the LED and the light sensitive diode is a vacuum space. When the LED is activated it turns on and can be seen by the light sensitive diode, causing a signal to be transmitted to any coupled connection, device or component. When optional component 103 is placed between direction detector 102 and output actuator 104 the output from direction detector 102 or the buffered output from buffer 103 results in a voltage 122 across output actuator 104.

Benefits of the present disclosure include: ability to run on very low voltage, can operate without a switch to buffer output, can be handheld instead of guitar-mounted (or another instrument), can also be instrument-mounted, output is usually on and can pulse off when string moves away, offset voltage can be chosen according to different embodiments, applicability to various string or slide instruments, better use for harmonics, allows for tremolo or bending of pitch), pickups can be formed with ring-shaped magnets (lending greater manufacturing versatility.

Regarding power and efficiency, sustainer embodiments under the present disclosure can run on two AA batteries. Prior art sustainers often need 9-volt batteries. One cause of this greater efficiency is less inherent resistance in the described sustainer embodiments. Prior art systems need greater voltage to overcome the inherent resistance of such systems. One benefit of the current disclosure is that a single 9-volt battery could run several sustainers at the same time.

Embodiments under the current disclosure can achieve some interesting and useful adjustments and behaviors regarding pitch. Some embodiments can allow a user to change the pitch of a string or resonant member of an instrument. The output of the sustainer can have an effect of pulling a string even when it wants to be moving away from the sustainer. Sustained polyphonic sounds can also be achieved. Prior art sustainers provide for multiple strings to share one pickup. The present disclosure allows for each string to be resonated/vibrated independently.

Figure 10:
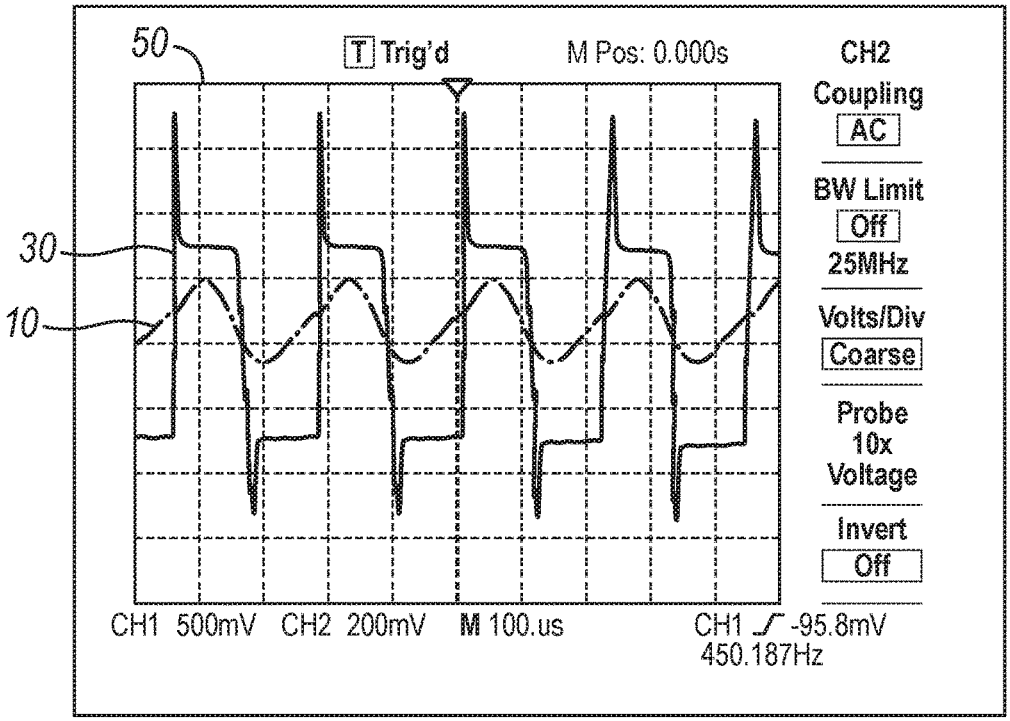
FIG. 10 shows a waveform embodiment under the present disclosure.
Figure 11:
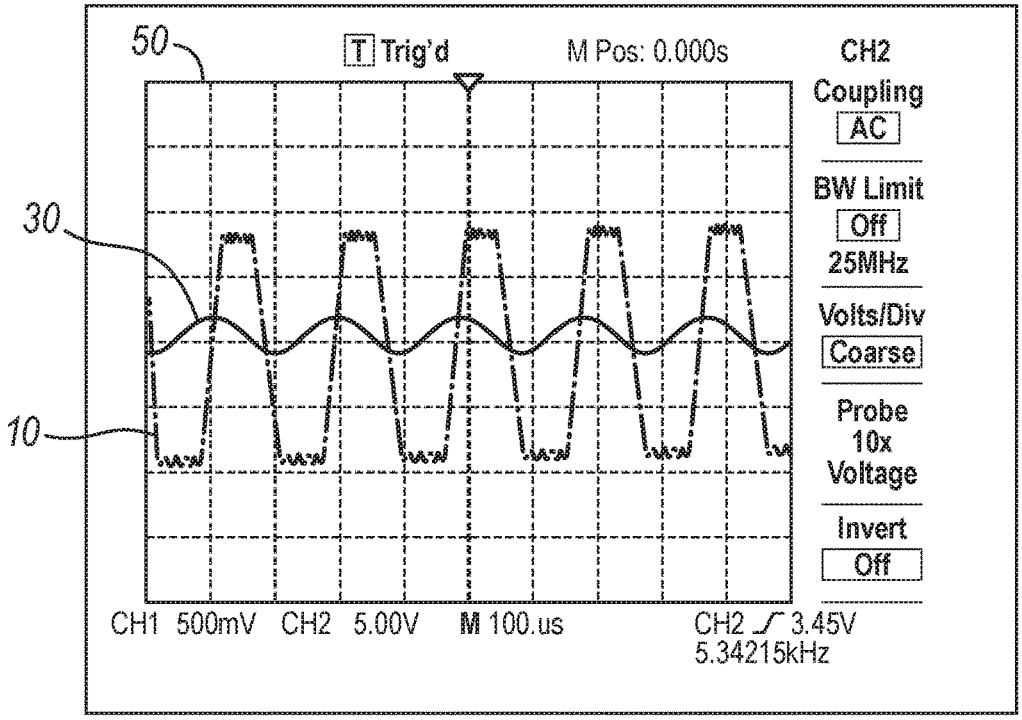
FIG. 11 shows a waveform embodiment under the present disclosure.
Figure 12:
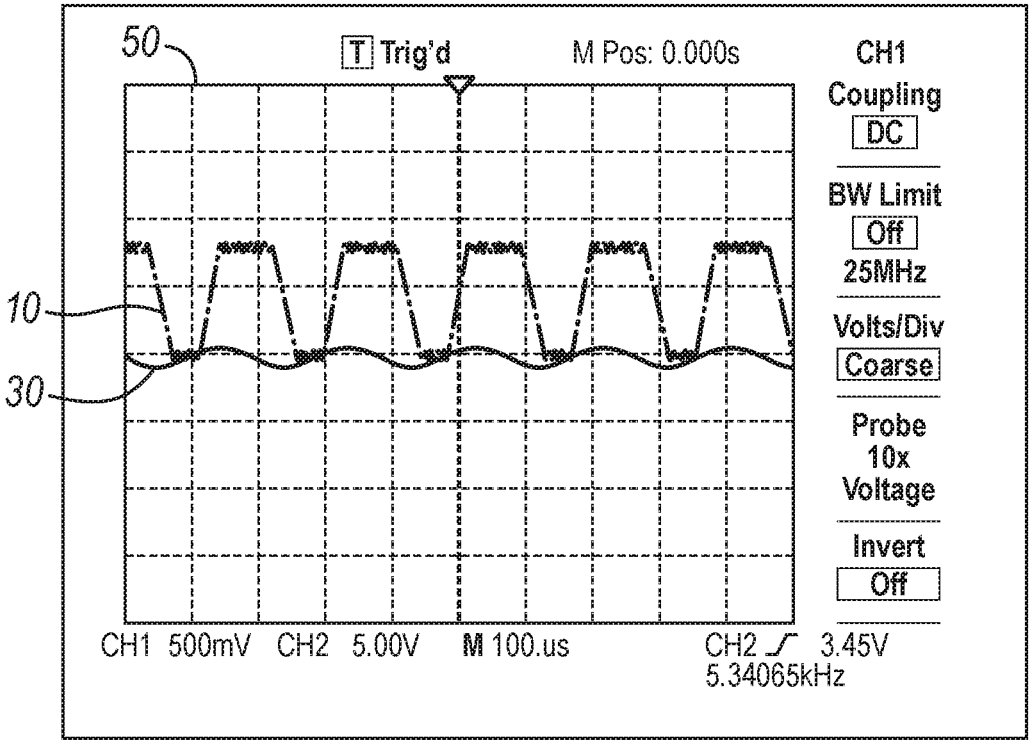
FIG. 12 shows a waveform embodiment under the present disclosure.

FIGS. 10-12 show possible embodiments of waveform behavior under the present disclosure. Each graph 50 shows output actuator line 10 and signal from pickup line 30. FIG. 10 shows a dual power supply setup. FIG. 11 shows a waveform of a signal that has gone through a low pass filter. FIG. 12 shows a single rail supply setup. FIG. 10 exhibits higher spikes than FIG. 11. This reflects that in FIG. 10 a longer waveform is combined with a lower frequency, allowing viewing of certain behavior not seen in higher frequency waveforms, such as in FIG. 11.

FIG. 12 displays a possible waveform associated with use of a sustainer under the present disclosure. Other embodiments are possible, including sustainers that continue an output even until after a decreasing input from a direction detector has passed zero into negative. In such situations there will be a voltage offset. An actuator output 4 from FIG. 1 can continue creating a magnetic field even after a signal from direction detector 2 has hit zero and gone negative. A resulting waveform can be seen in FIG. 12. Sinusoidal wave 10 represents a signal from a direction detector as a resonant string oscillates. Line 20 represents the resultant output signal from actuator output 4. As can be seen, even after wave 10 goes negative, the actuator output 4 continues for an offset period. Embodiments that yield a waveform such as in FIG. 3 can yield useful sound behavior for certain users. Obtaining the offsets seen in FIG. 12 can be achieved using an appropriate amplifier, buffer, or other circuitry that delays the signals sent to an actuator output 4. The offset or delay in the output response to a zero or negative input signal can be very small, such as several millivolts or can only last several milliseconds, depending on a user's preferences. The delay could in practice be similar to pulse width modulation (PWM), or similar to electrical signal changes that come with varying a duty cycle.

FIGS. 13A-13F show various embodiments of a sustainer under the present disclosure also comprising various types of input biasing. Each of FIGS. 13A-13F comprise a detector 2*x*, pickup ground 12*x*, power source 4*x*, power ground 9*x*, noninverting input 14*x*, inverting input 15*x*, operational amplifier 3*x*, amplifier ground 11*x*, output actuator 5*x*, actuator ground 13*x*, ground signal 6*x*, detector signal 7*x*, and output 10*x*. North and south poles are shown representing the polarity of the pickups 2*x* and output actuators 5*x*. Resistors 20*x* are shown on connections between the power source 4*x* and either the ground signal 6*x* or detector signal 7*x*. In each figure, the arrangement of resistors 20*x* will bias the operational amplifier 3*x* to use either the noninverting input 14*x* or to instead use the inverting input 15*x*.

Figure 13A:
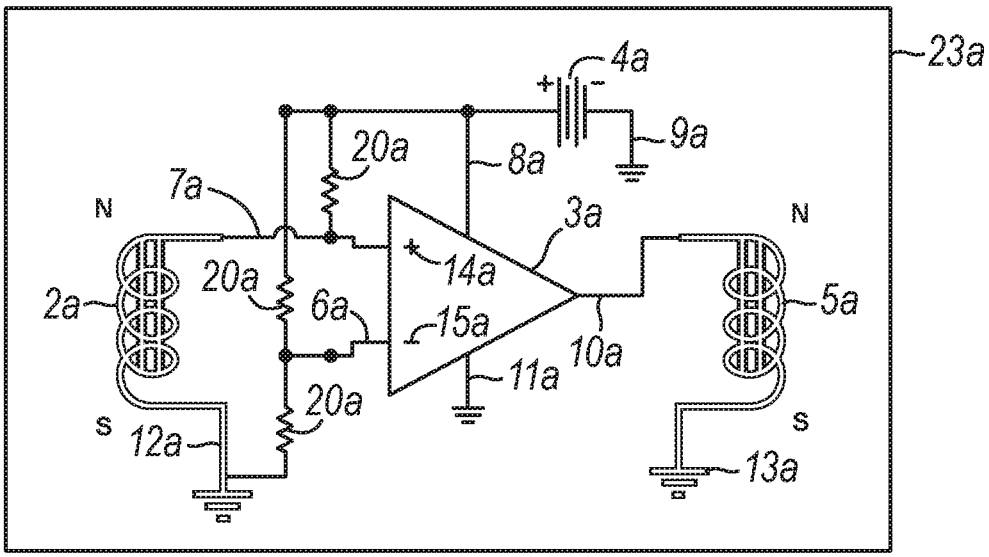
FIGS. 13A-13F show embodiments of sustainer circuitry under the present disclosure.
Figure 13B:
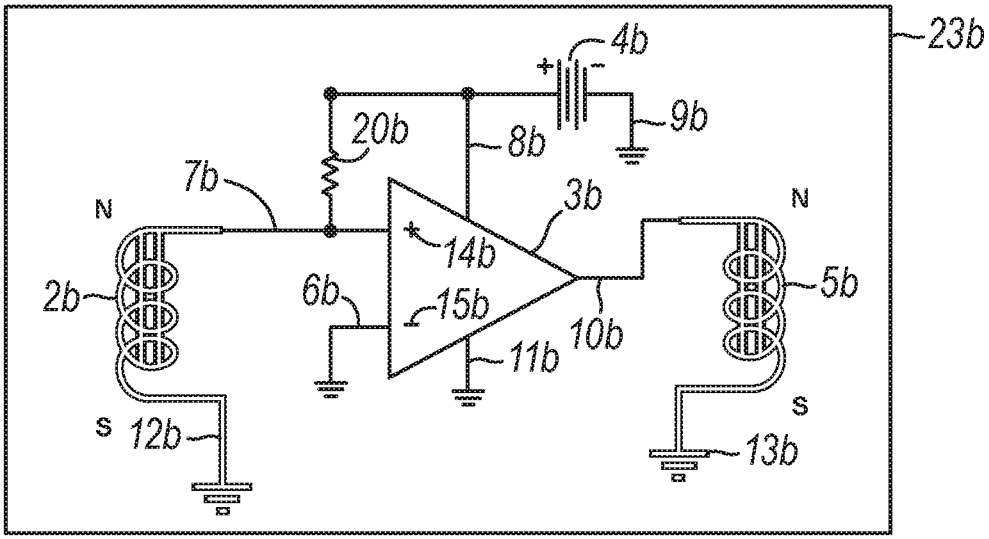
Figure 13C:
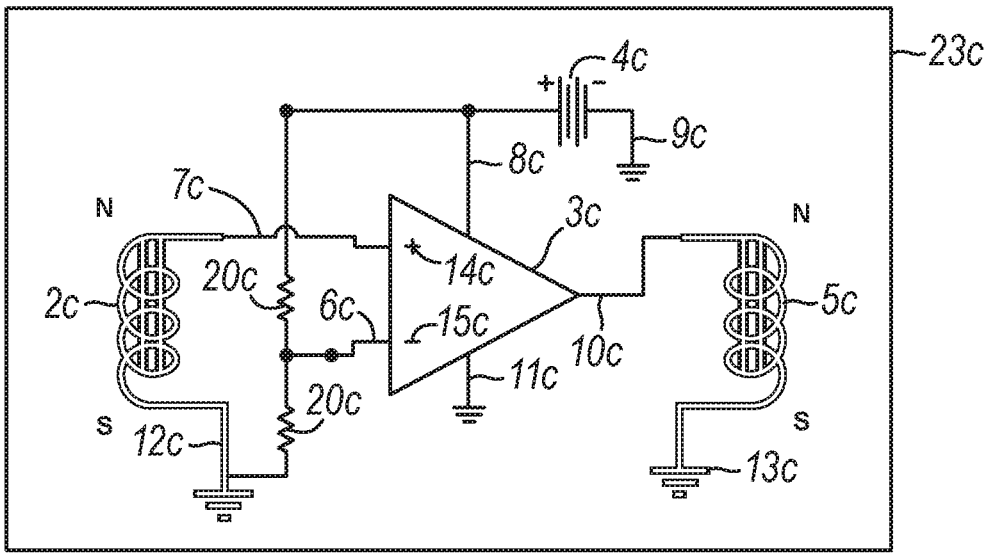
Figure 13D:
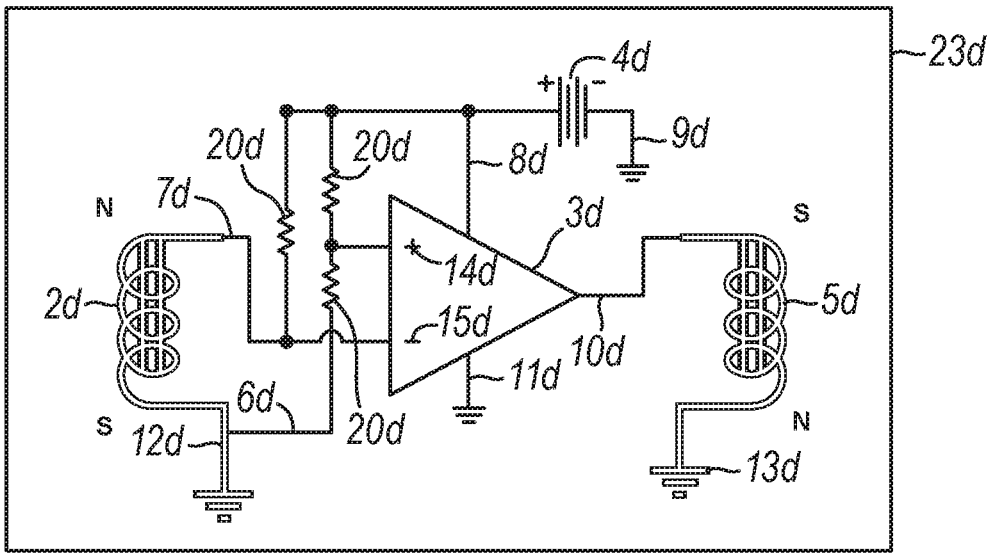
Figure 13E:
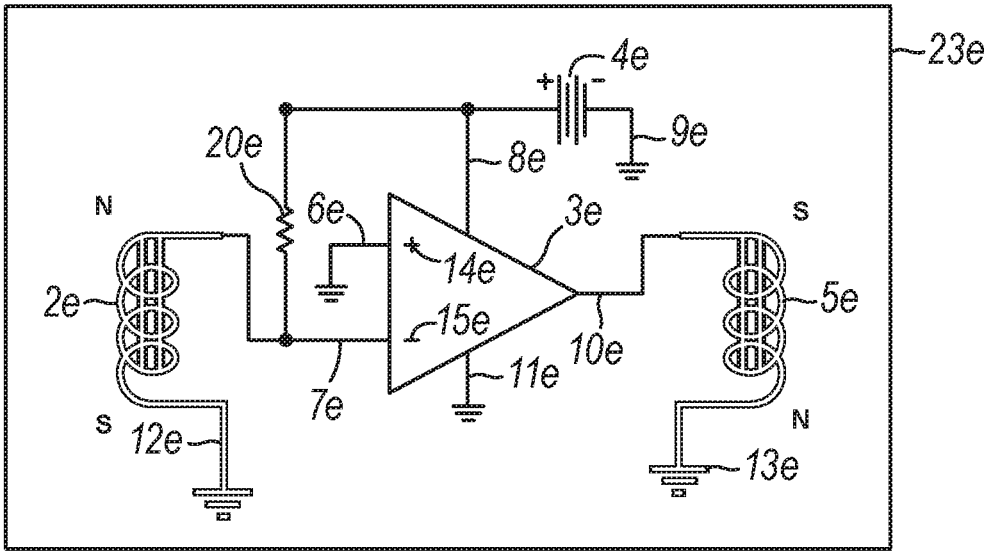
Figure 13F:
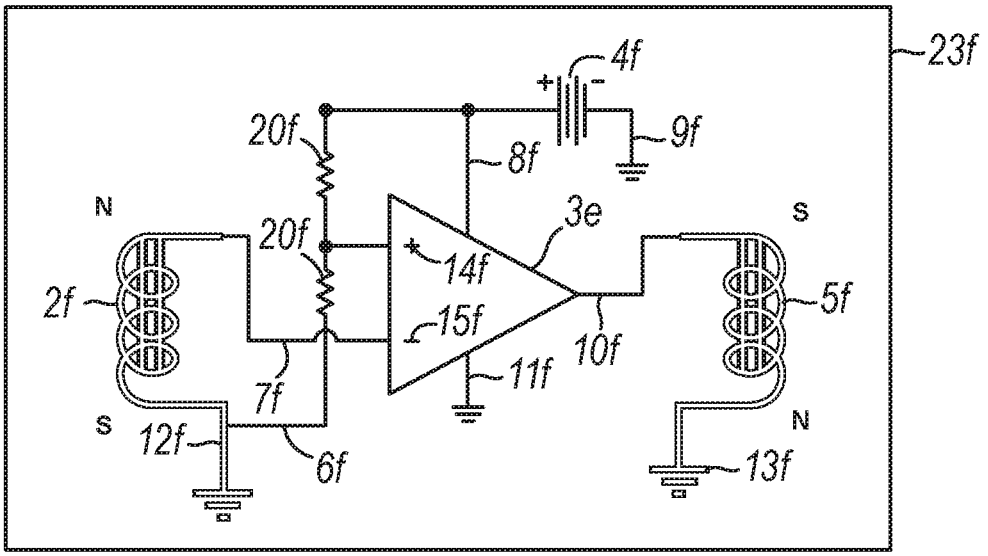

FIGS. 13A-13C show systems that are in phase. FIGS. 13D-13F show systems that are out of phase. In FIG. 13A-13F coils are shown in pickups/detectors 2*x* and output actuators 5*x* (and in other figures described herein). A person of skill in the art would understand the coiling (clockwise or counterclockwise) used to form the requisite or described magnetic field. The coiling illustrations in these figures are not meant to be dispositive for how coiling would appear in a physical embodiment.

FIGS. 13A and 13D show one resistor 20*x* between detector signal 7*x* and power source 4*x*, as well as two resistors 20*x* between ground signal 6*x* and power source 4*x*. Because FIG. 13A is in phase (N being upward on both the detector 2*a* and the actuator 5*a*), detector signal 7*a* must be connected to noninverting input 14*a* for the sustainer to be most effective. Because 13D is out of phase (N being upward on the detector 2*d* and downward on the actuator 5*d*), detector signal 7*d* must be connected to inverting input 15*d* for the sustainer to be most effective.

The same pattern holds for the other figures. FIGS. 13B and 13E show one resistor 20*x* connecting detector signal 7*x* to power source 4*x*, and none between ground signal 6*x* and power source 4*x*. When in phase (FIG. 13B), detector signal 7*b* connects to noninverting input 14*b*. When out of phase (FIG. 13E), detector signal 7*e* connects to inverting input 15*e*.

FIGS. 13E and 13F show one resistor 20*x* connecting ground signal 6*x* to power source 4*x*, another resistor 20*x* between ground signal 6*x* and ground 12*x*, and none between detector signal 7*x* and power source 4*x*. When in phase (FIG. 13C), detector signal 7*c* connects to noninverting input 14*c*. When out of phase (FIG. 13F), detector signal 7*f* connects to inverting input 15*f*.

The embodiments of FIGS. 13A-13F can allow user to have greater control over input and behavior of the duty cycle. Exact sound or waveform behavior of these embodiments can depend on the exact structure of the processing chips comprising operational amplifiers 3*x*. Each manufacturer of operational amplifiers 3*x* makes their chips differently and each can interact uniquely with the inputs described. Each embodiment can have sustaining functionality, but specific sound differences and behaviors can depend on chip structure. If FIGS. 13A-13C connected detector signal 7*x* to inverting input 15*x*, or if FIGS. 13D-13F connected detector signal 7*x* to noninverting input 14*x*, then the string might be dampened instead of sustained (though this can depend on the operational amplifier being used and the specific circuitry therein). Such systems could lead to unique sounding harmonics, but might not function as sustainers.

Figure 14A:
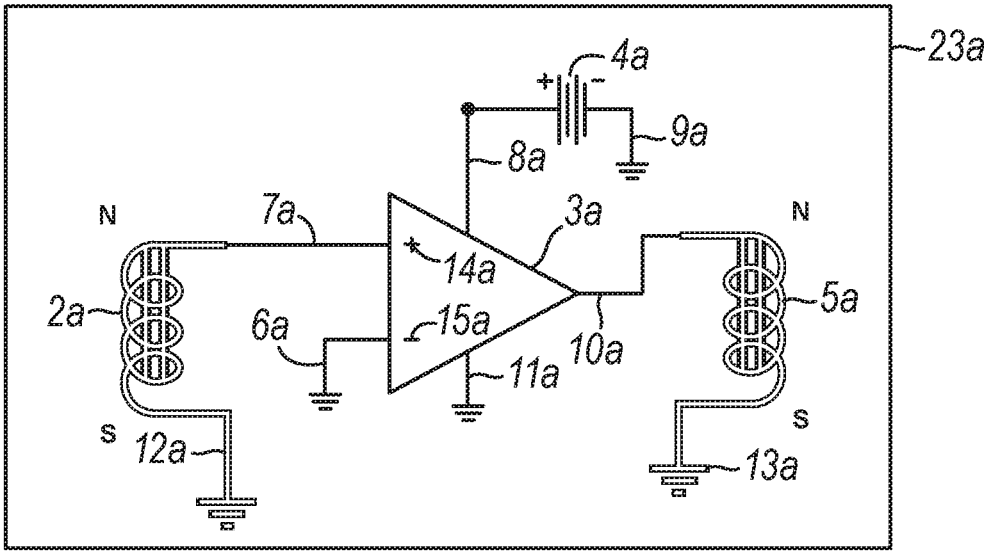
FIGS. 14A-14D show embodiments of sustainer circuitry under the present disclosure.
Figure 14B:
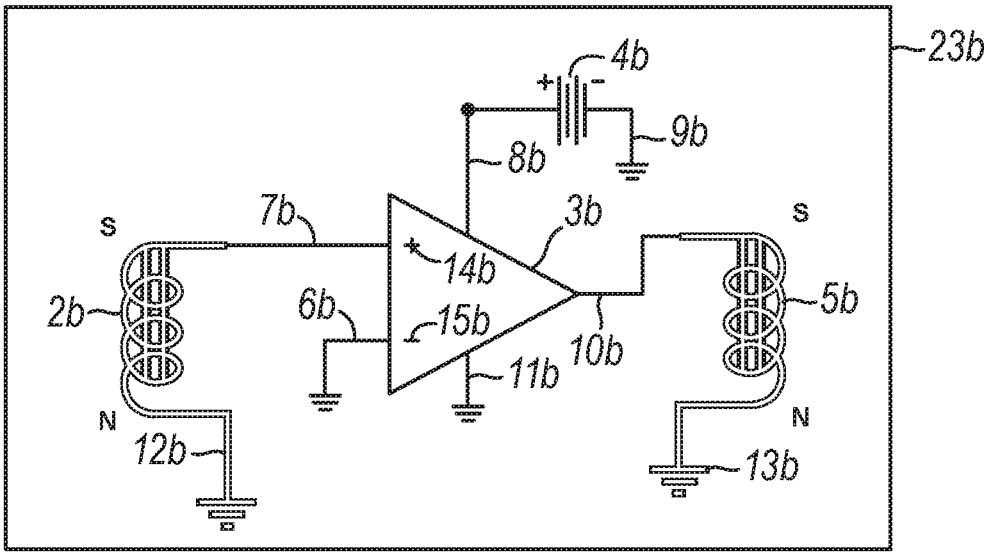
Figure 14C:
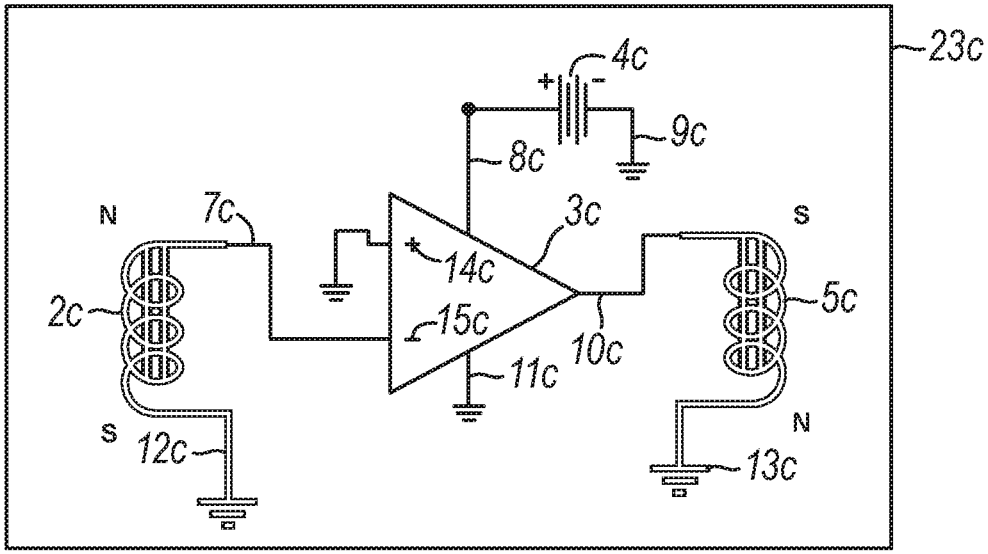
Figure 14D:
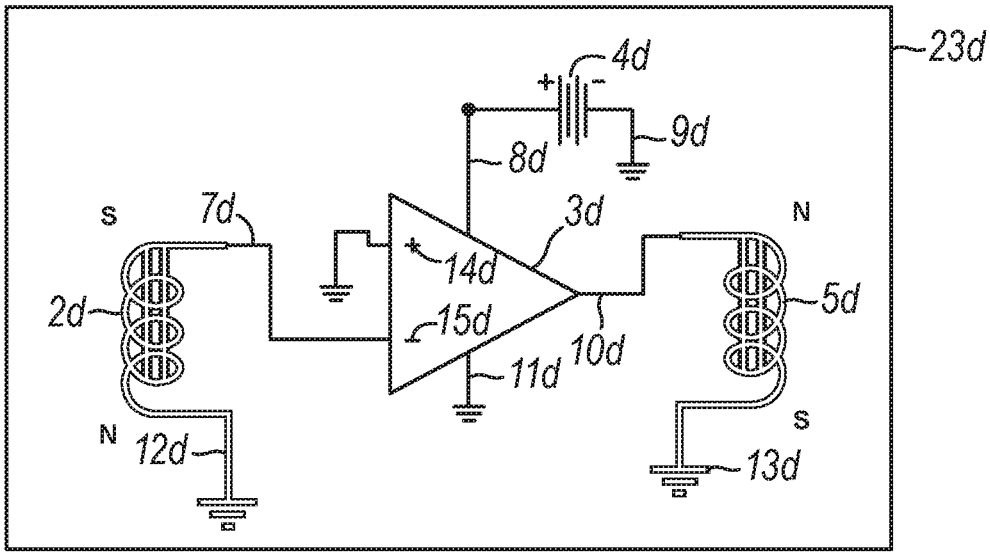

FIGS. 14A-14D show several embodiments under different polarity setups. FIGS. 14A-14D have similar elements as FIGS. 13A-13F. FIGS. 14A and 14B are both in phase—FIG. 14A with N upward and FIG. 14B with S upward. Either way, detector signal 7*a/b* connects to noninverting input 14*a/b*. In FIGS. 14C and 14D the system is out of phase—FIG. 14C with the detector 2*c* having N upward and in FIG. 14D the detector 2*d* having S upward. Either way, detector signal 7*c/d* connects to inverting input 15*c/d*. Similarly to FIGS. 13A-13F, if the embodiments of FIGS. 14A-14D were connected incorrectly, then a resonant string is dampened, possibly leading to really intense harmonics, and it would basically cancel out the sound of the string.

Figure 15A:
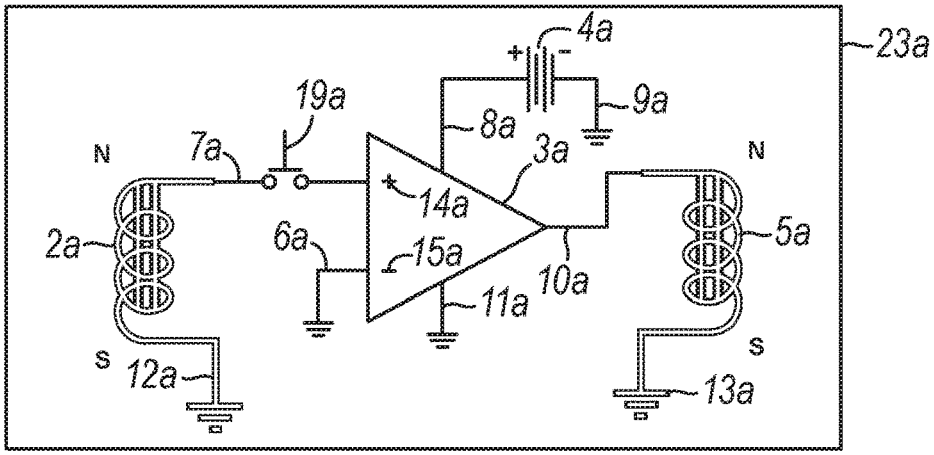
FIGS. 15A-15C show embodiments of sustainer circuitry under the present disclosure.
Figure 15B:
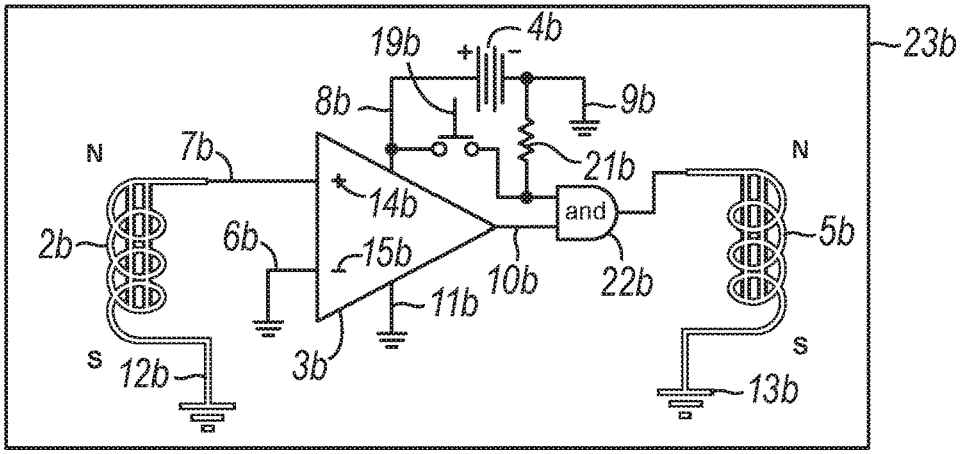
Figure 15C:
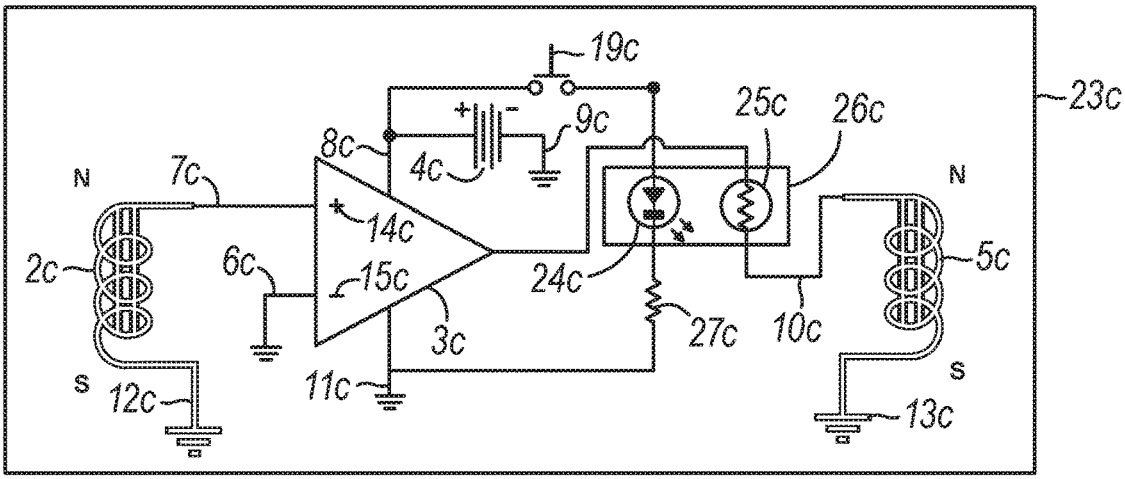

FIGS. 15A-15C display embodiments comprising various setups of switches 19*a/b/c*. Switches 19*a/b/c* could take a variety of forms: always on (normally on), always off (normally off), proximity sensor for a user's finger, on/off mechanical switch, or others. Each embodiment of switch 19*a/b/c* allows a user to turn a sustainer on and off. Other elements of FIGS. 15*a*-15*c* are similar to those of FIGS. 13A-13F.

In FIG. 15A, switch 19*a* connects detector signal 7*a* to noninverting input 14*a*. A user activating the switch 19*a* can control whether the system is on or off. FIG. 15B allows a user similar control, but by different means. And gate 22*b* receives operation amplifier output 10 and input 8*b* from power source 4*b*. When switch 19*b* is disconnected/off, input 8*b* will not reach and gate 22*b* and no signal will be received by output actuator 5*b*. Only when both output 10*b* and input 8*b* are both received by and gate 20 will there be a signal for output actuator 5*b*. FIG. 15C shows an embodiment with an opto coupler 25*c*. Operational amplifier output 10*c* passes through a light sensitive resistor 26*c* in opto coupler 25*c*. The light sensitive resistor 26*c* operates to prevent output 10*c* from reaching output actuator 5*c*. Light emitting diode (LED) 24*c* receives input 8*c* from power source 4*c* when switch 19*c* is connected/on. When the LED 24*c* shines light on the light sensitive resistor 26*c* within opto coupler 25*c*, the resistance is lessened and output 10*c* is allowed to reach output actuator 5*c*. The user, by controlling switch 19*c* is able to control the sustainer as desired.

Figure 16:
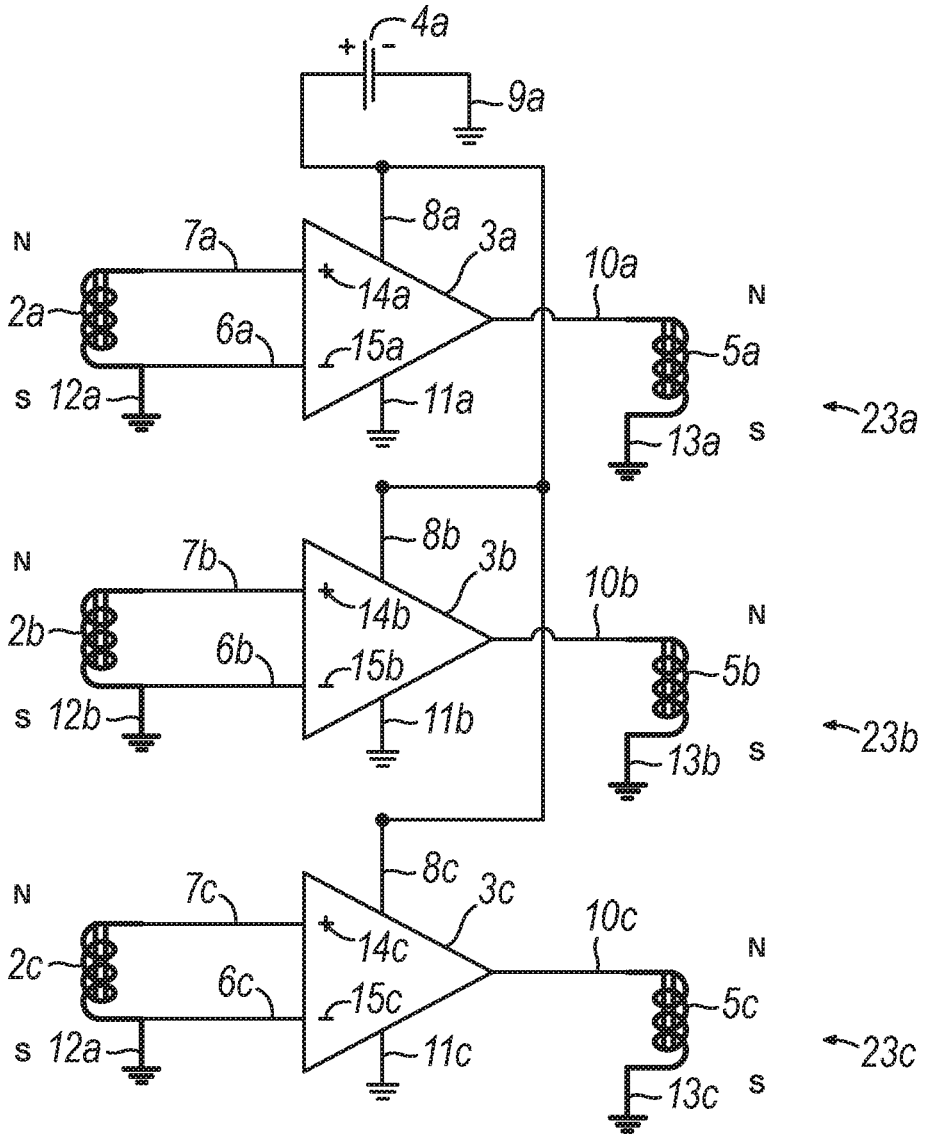
FIG. 16 shows an embodiment of sustainer circuitry under the present disclosure.
Figure 17:
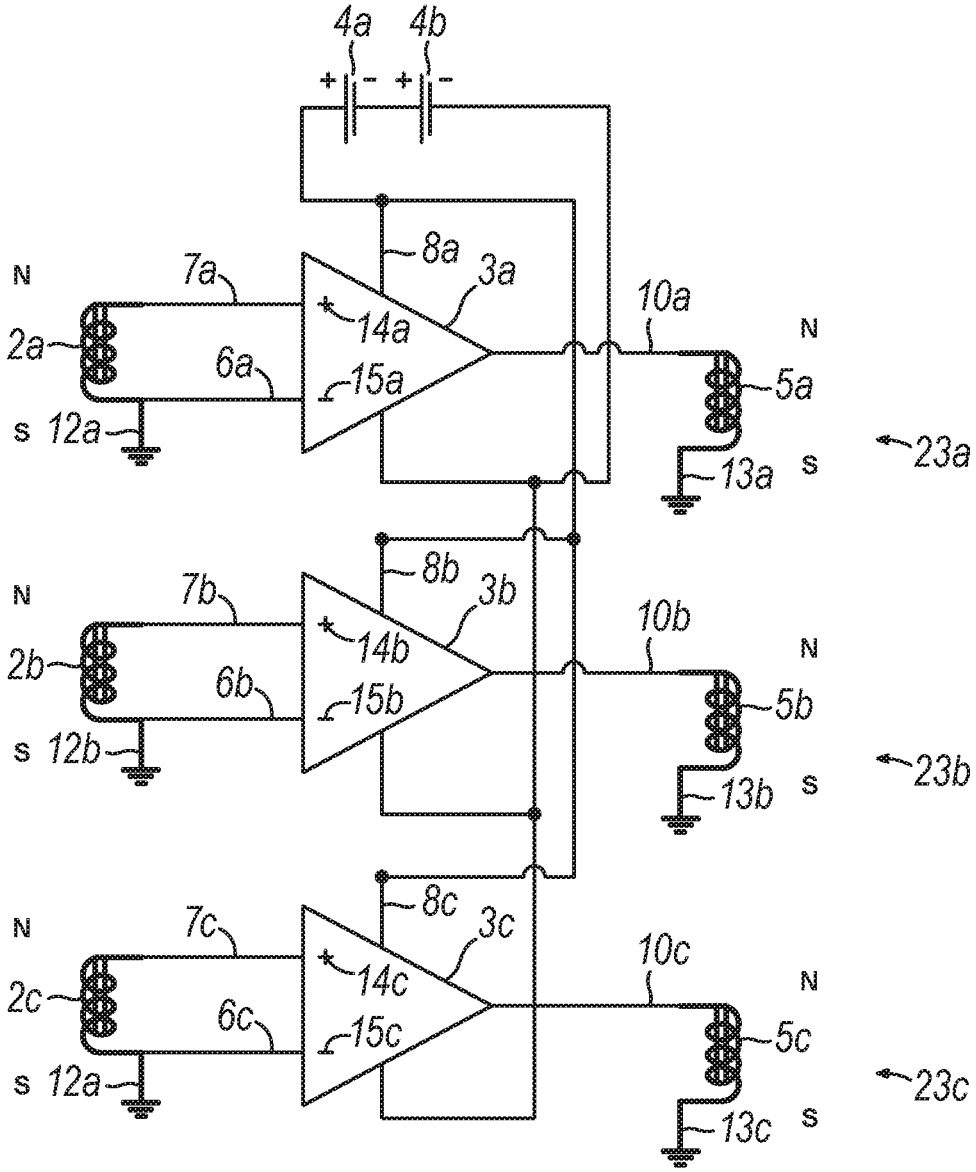
FIG. 17 shows an embodiment of sustainer circuitry under the present disclosure.
Figure 18:
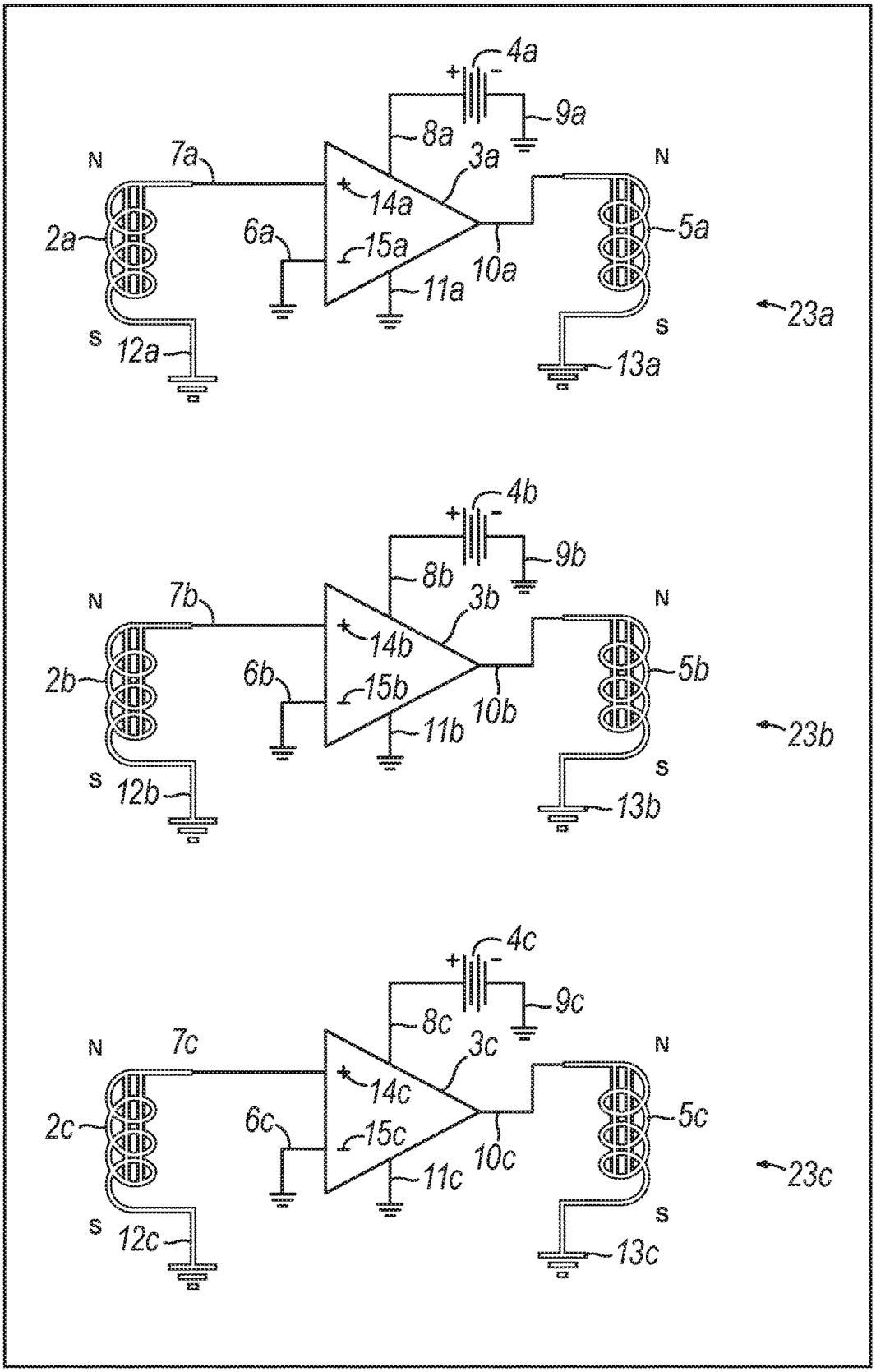
FIG. 18 shows an embodiment of sustainer circuitry under the present disclosure.

FIGS. 16-18 show embodiments for polyphonic sustainers under the present disclosure. Polyphonic embodiments can embody one sustainer under each string/resonant element, or multiple strings, on a single instrument. Other embodiments could comprise multiple sustainers placed at different locations for a single string. For instance, placing a sustainer at different harmonic nodes for a single string could lead to desirous sound qualities. FIGS. 16-18 comprise similar elements to FIGS. 13*a*-13*f* with similar numbering of elements.

FIG. 16 shows multiple sustainers 23*a/b/c* with detector 2*a/b/c*, operational amplifier 3*a/b/c*, output 10*a/b/c*, and output actuator 5*a/b/c*. Power source 4 powers each sustainer 23*a/b/c*. FIG. 17 shows a similar embodiment but with a dual rail power supply 4*a* and 4*b*. Dual rail power supply embodiments can comprise a VCC connection on top of each operational amplifier 3*a/b/c* and a VDD on the bottom of each operational amplifier 3*a/b/c*. FIG. 18 shows a similar embodiment but with a separate power source 4*a/b/c* for each sustainer 23*a/b/c*.

FIGS. 13A-18 show various embodiments of input biasing, switches, polyphony, and polarity. The various elements of these embodiments can be combined. The input biasing of FIG. 13B could be combined with one of the switches of FIGS. 15A-15C, in a polyphonic arrangement of FIG. 16, for example. Other combinations of these elements can be utilized while staying within the teachings of the current disclosure which is not limited to only one such combination. Other elements of FIGS. 1-12 or as discussed herein can similarly be combined while implementing the current disclosure.

Some embodiments of the current disclosure discuss an electrical signal being generated at a direction detector or pickup and being transmitted through various elements of the sustainer to the output actuator. It will be recognized by those of skill in the art that an electrical signal generated at one part of a sustainer, as described, may be amplified, split, combined or otherwise adjusted as it proceeds through the circuitry of the sustainer to the output actuator. While an original electrical signal may not always be identical to a final signal received at an output actuator, the person of skill would understand the intent of the description herein.

Direction detectors or pickups that detect movement of a resonant string, as herein described, may be described as detecting nearby movement, or movement in close proximity. A person of skill in the art would understand the types of physical distances commonly used or assumed to be the range of influence that detectors or pickups may have. Detectors or pickups for instruments with resonant elements or strings generally work at distances of less than 1 foot, and most likely within 1 inch. Other distances may be possible depending on the specific embodiment, circuitry, or power used in a specific embodiment.

Figure 19A:
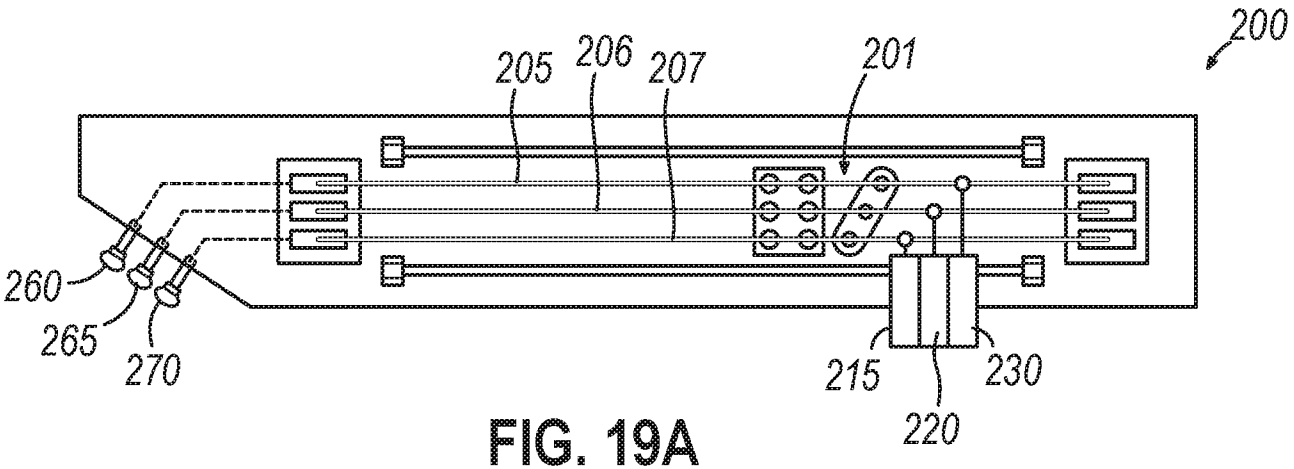
FIGS. 19A-19B show an instrument embodiment under the present disclosure.
Figure 19B:
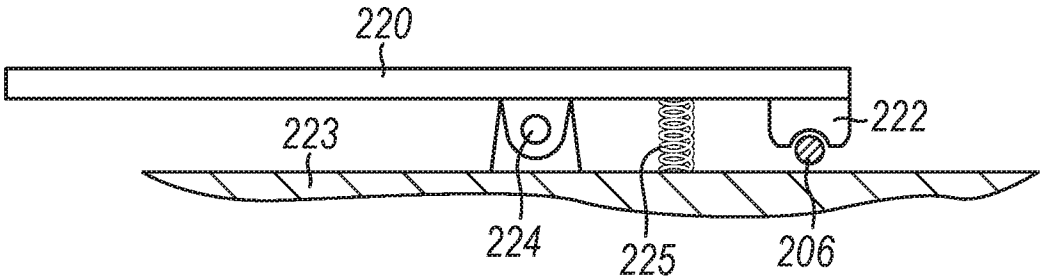

FIGS. 19A and 19B show an embodiment of a slide rail instrument 200 under the present disclosure. Instrument 200 comprises strings 205, 206, 207, and pickup and sustainer components 201. Tuning pegs 260, 265, 270 can adjust pitch of the strings 205, 206, 207. Arms 215, 220, 230 can be used to dampen the sound of each string. FIG. 19B shows a side view of arm 220 but is representative of arms 215, 230 as well. Damper 222 can make contact with string 206 to dampen the string's vibration or sound. Spring 225 provides rotational movement (or prevents it) around pivot point 224. Body 223 of arm 220 can be maneuvered by a user. In this embodiment a spring 225 is shown between the pivot point 224 and the damper 222. Other embodiments could place a spring elsewhere or use magnetic force to move or hold the arm 220 in place. Such other embodiments would mean the user would use different movement to actuate arm 220.

Figure 20:
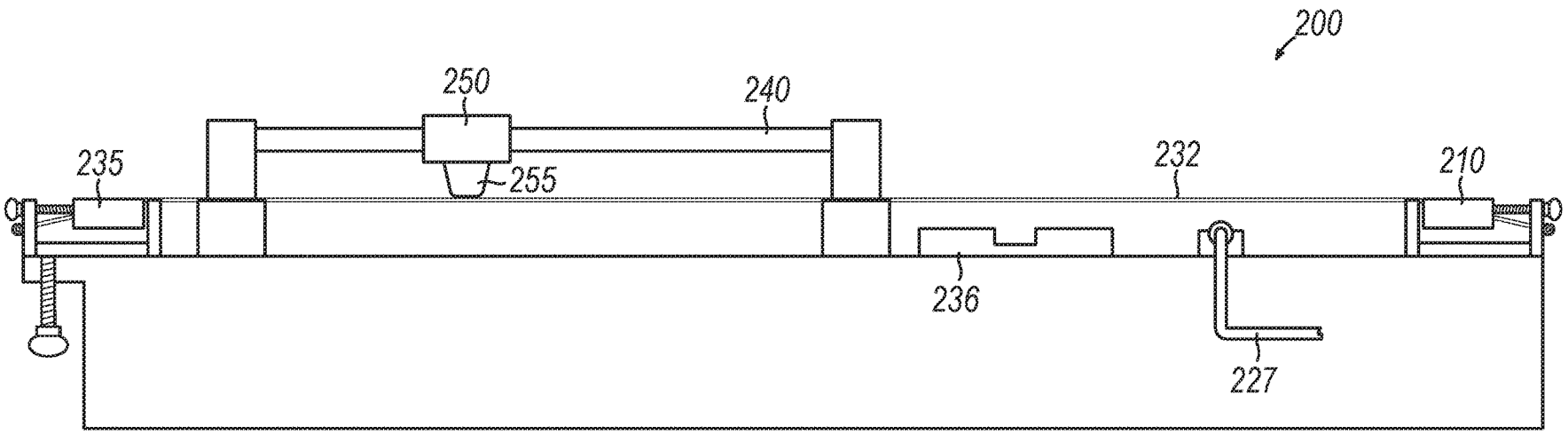
FIG. 20 shows an instrument embodiment under the present disclosure.

FIG. 20 shows another instrument embodiment under the present disclosure. Instrument 200 comprises a string 232 (there can be more than one), sustainer 236, audio out 227, tuning knob 230 to adjust pitch of string 232, saddle 235, saddle 210, slide bar 240, pitch bar 255 connected to slide 250. Slide 250 is allowed to slide along slide bar 240 which is preferably metal. Slide 250 may comprise holed out portions allowing for such movement. String 232 may be resonated via sustainer 236, via plucking or some other means, and contact between pitch bar 255 and string 232 adjusts the string's pitch. Instrument 200 may have multiple strings 232. Pitch bar 255 may contact one, multiple or all of strings 232. Multiple pitch bars 255 may allow a user to independently adjust pitch of strings 232. Multiple pitch bars 255 may slide on multiple different slide bars 240. Adjacent slides 250 may share one slide bar 240 but also use separate slide bars 240 on their non-adjacent sides.

Figure 21A:
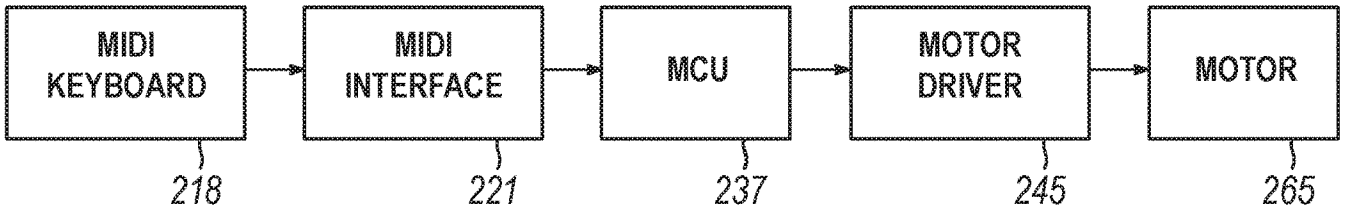
FIGS. 21A-21B show an instrument embodiment under the present disclosure.
Figure 21B:
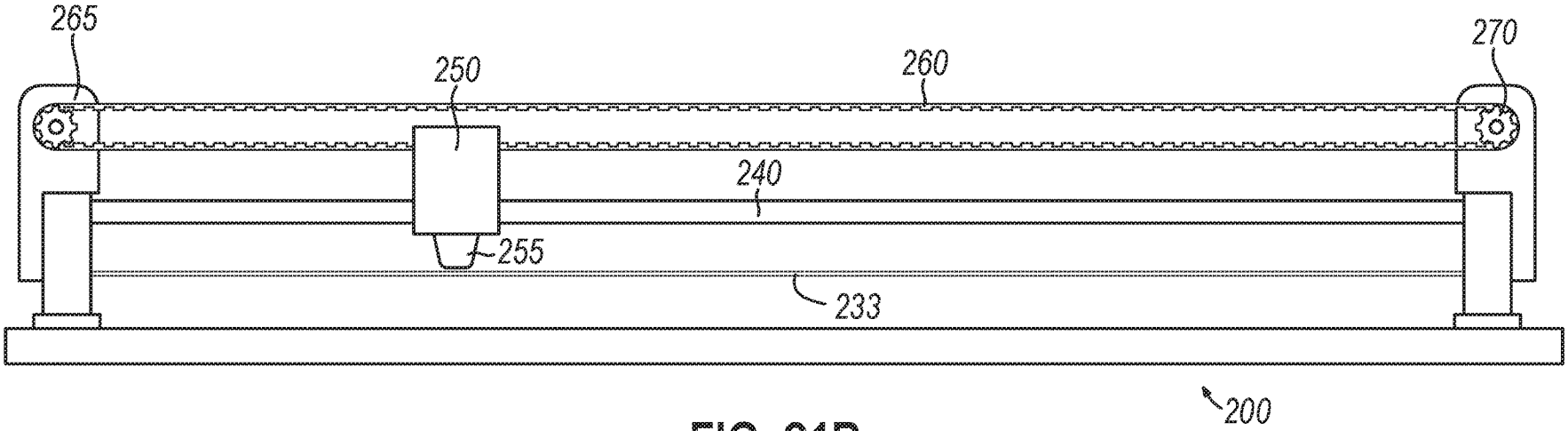

FIGS. 21A and 21B show another instrument embodiment under the present disclosure. Instrument 200 is a MIDI-enabled instrument. MIDI stands for musical instrument digital interface. String 233 can be contacted by pitch bar 255 of slide 250 that slides along slide bar 240. Slide 250 also contacts belt 260. Belt 260 may comprise teeth that engage slide 250 as well as motor 265 and gearing 270. Motor 265 can control the belt 260 and thereby the placement of slide 250, and thereby the pitch of string 233. A user may control motor 265 by a programming system or through a communicatively coupled keyboard or interface. FIG. 21B shows a possible connection between a MIDI keyboard 218, coupled to a MIDI interface 221, coupled to a microcontroller 237, coupled to a motor driver 245, coupled to motor 265 of FIG. 21A. Motor 265 can comprise a stepper motor, servo motor, or other appropriate motor. Instrument 200 can comprise sustainers, input biasing, or other components described herein.

Figure 22A:
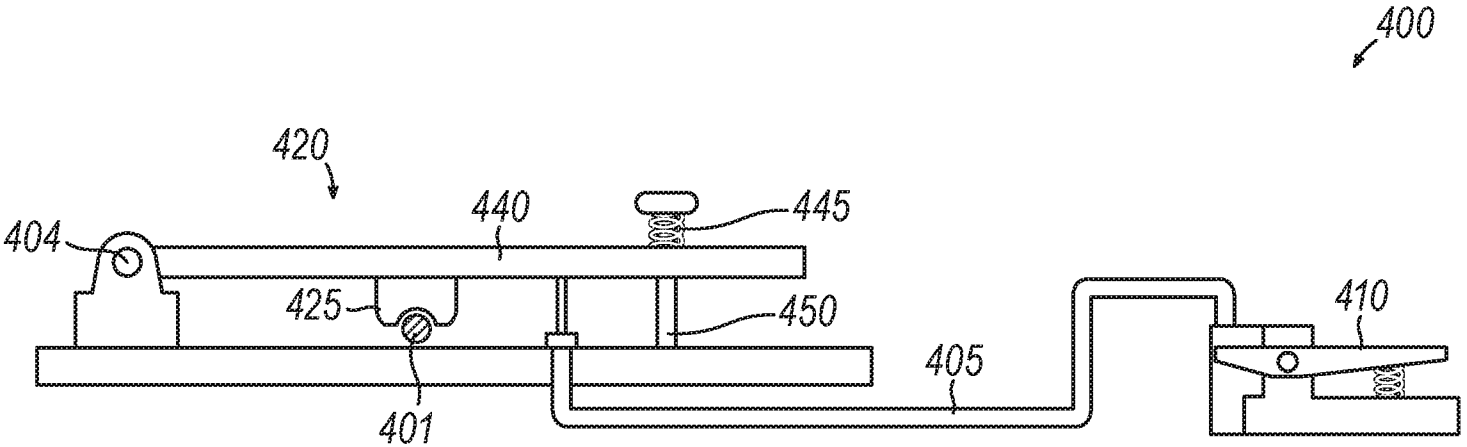
FIGS. 22A-22B show an instrument embodiment under the present disclosure.
Figure 22B:
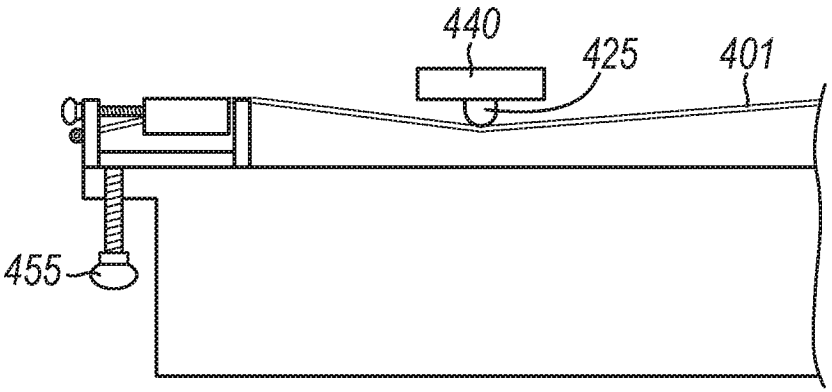
Figure 23:
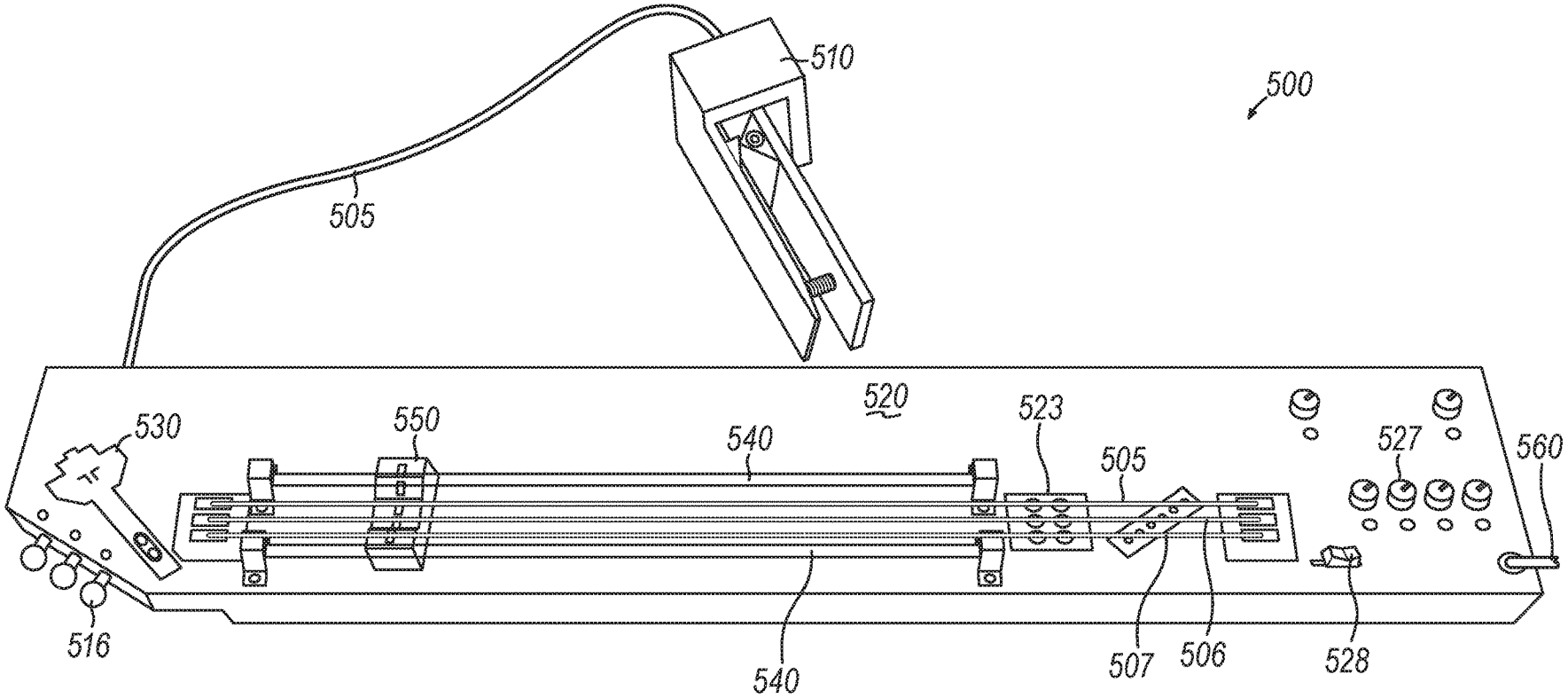
FIG. 23 shows an instrument embodiment under the present disclosure.

FIGS. 22A and 22B show an embodiment of a pitch system embodiment 400 with a foot pedal 410. Foot pedal 410 allows a user to activate a pitch apparatus 420 via cable 405. The signal or pressure from cable 405 can cause arm 440 to move upwards in this embodiment. Spring 445 at rest state holds arm 440 down, causing surface 425 to press against string 401. Arm 440 moves about pivot point 404 and may move up and down along rod 450. Although this embodiment shows surface 425 physically touching string 401 in a rest state, the layout of the spring and pivot point could be altered to effect a rest state in which surface 425 does not touch string 401. FIG. 22B shows a side view of arm 440 and surface 425 engaging string 401. String 401 can also be seen connected to a tuning knob 455. The described pitch system allows the user to bend pitch of a string. This can create minor or major chords FIG. 23 shows an instrument embodiment of a slide device with a foot pedal. Foot pedal 510 connects via cable 505 to body 520. Body 520 comprises strings or resonant members 505, 506, 507, sustainer device 523, slide bars 540, slide 550, tuning knobs 516, and pitch apparatus 530. Enablement toggles 527 may be used to control a sustainer, pickup, or other component of instrument 500. Audio out 560 may connect to a speaker, computer, or other device. Key 528 can be used to control a low pass filter or other component or characteristic of the system, such as volume. Pitch apparatus 530 can comprise an apparatus substantially similar to pitch apparatus 420 in FIG. 22A. In a preferred embodiment pitch apparatus 530 will be used to contact or dampen the sound of one of strings 505, 506, 507. Pitch apparatuses that engage more than one string are possible however. Similar to FIG. 22A, foot pedal 510 can be used by a musician to turn the pitch apparatus 530 on or off. Pitch apparatus 530 can be adjusted to be normally off or on. A single instrument 500 could have multiple foot pedals, each engaging a different string or adjusted to have some other effect.

Embodiments described herein can include an approaching detector or a receding detector. For example, referring back to FIG. 6, the embodiment shown comprises a direction detector (generally comprising pickup 2 and operational amplifier 3) that is an approaching detector—it detects movement toward the pickup 2. However, if output 7 were connected to inverting input 15 instead of noninverting input 14, then the sustainer would operate to detect movement away from the pickup 2 (i.e. a receding detector). It should be noted that not all operational amplifiers will have same circuitry. So this ability to change types of direction detector (from approaching detector to receding detector, and vice versa) may not exist in all embodiments. A receding detector could also be called an inverted direction detector, or inverted approaching detector. A receding detector would function to alter a magnetic field or alter a magnetic flux as a string is moving away, leading to unique sound characteristics. Referring back to Table 1 and Table 2, an embodiment of a receding detector would result in the bottom two rows being opposite values. Embodiments under the present disclosure could also include sustainer systems with both approaching detectors and receding detectors in the same system, in the same instrument, or the same handheld device. Such embodiments could use one pickup, shared by the detectors, one or more operational amplifiers, and would preferably use two output actuators.

Figure 25:
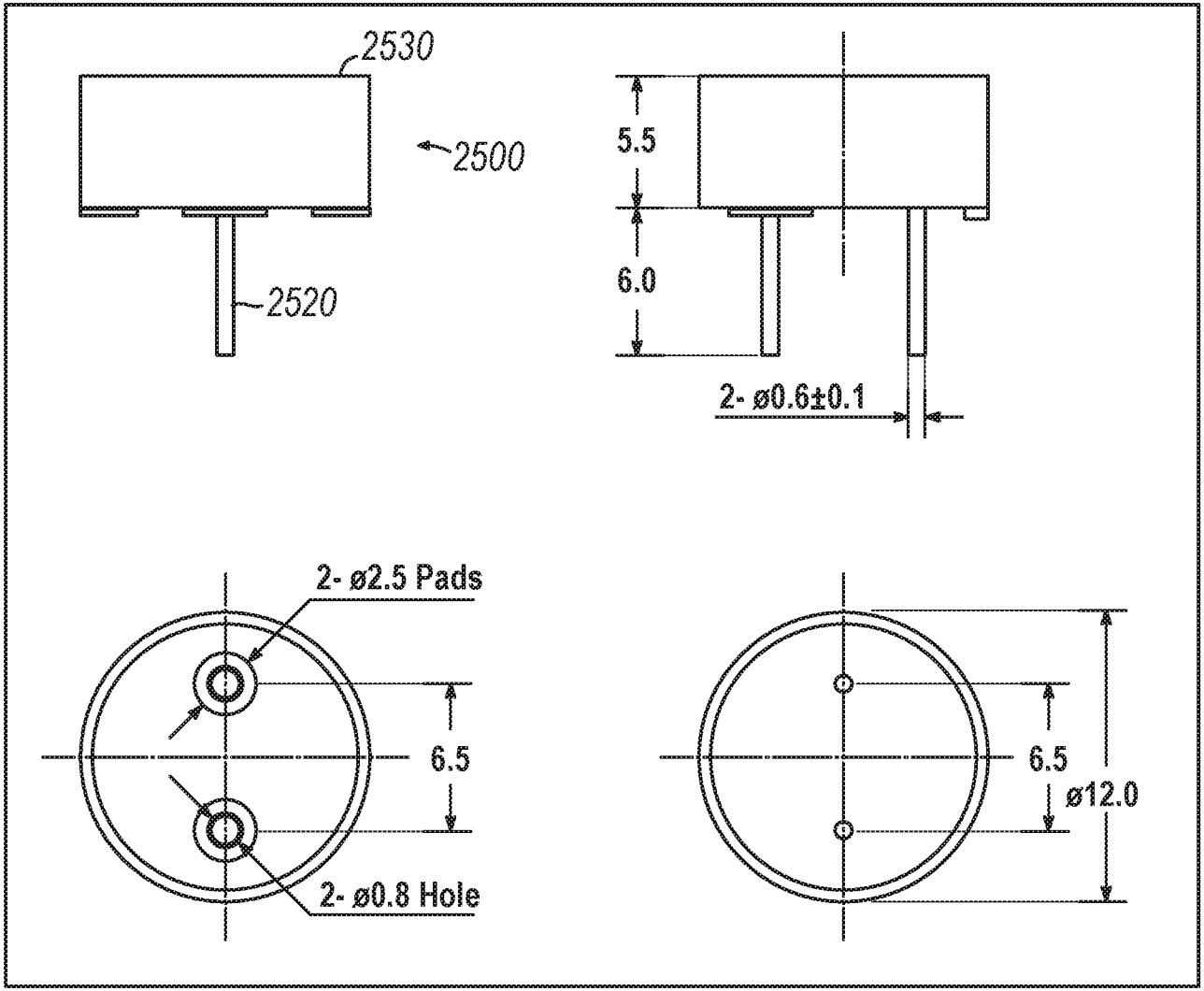
FIG. 25 shows a magnet embodiment under the present disclosure.

Some embodiments under the current disclosure can utilize ceramic magnets around the coil in a pickup. Prior art pickups typically have magnets located at the bottom of the pickup. One embodiment of such an apparatus 2500 can be seen in FIG. 25. Ceramic magnets 2530 surround coil or wiring 2520. Apparatus 2500 can be used, for example, as pickups or output actuators under the present disclosure. In FIG. 6, for example, apparatus 2500 could comprise pickup 2 or output actuator 5.

Figure 24:
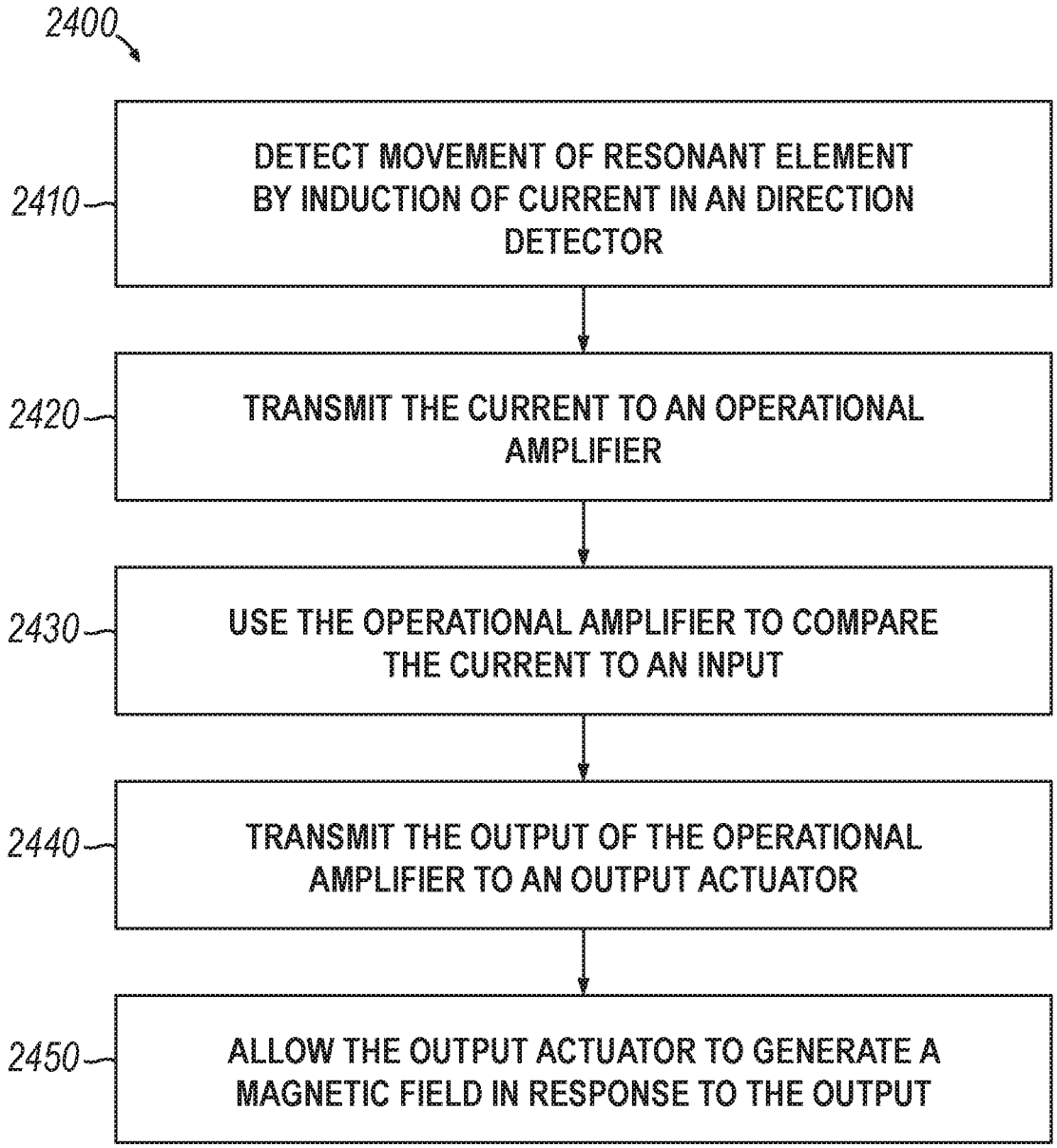
FIG. 24 shows a method embodiment under the present disclosure.

FIG. 24 displays a possible method embodiment 2400 under the present disclosure. At step 2410, a movement of a resonant element is detected by induction of current in a direction detector. At step 2420, the current is transmitted to an operational amplifier. At step 2430, the operational amplifier is used to compare the current to an input. At step 2440, an output of the operational amplifier is transmitted to an output actuator. At step 2450, the output actuator is allowed to generate a magnetic field in response to the output, the magnetic field configured to sustain the movement of the resonant element when the resonant element is moving towards the pickup.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A stringed instrument comprising;

a resonant string;

a direction detector configured to generate an electrical signal in response to movement of the resonant string, the electrical signal signifying movement away from or toward the direction detector, wherein the direction detector comprises a pickup and a logic circuit, the pickup configured to transmit an output current to the logic circuit, the output current being positive when the string is moving towards the direction detector and negative when the string is moving away from the direction detector, the logic circuit configured to receive the output current from the pickup and to compare the output current to ground and to transmit the electrical signal to the output actuator, the logic circuit further configured to provide an electrical signal of 1 when the output current is positive and to provide an electrical signal of 0 when the output current is negative;

an output actuator electrically coupled to the direction detector and configured to, in response to the electrical signal, generate an output magnetic field for sustaining the movement of the string when it is moving toward the direction detector.

2. The stringed instrument of claim 1 further comprising a damper apparatus configured to allow a user to dampen the sound of the resonant string.

3. The stringed instrument of claim 1 further comprising a slide configured to move along the length of the resonant string and change the pitch of the resonant string.

4. The stringed instrument of claim 3 further comprising a belt coupled to the slide, a motor coupled to the belt, and a MIDI interface coupled to the motor, the MIDI interface operable to allow a user to control the motor so as to direct the movement of the belt and slide.

5. The stringed instrument of claim 1 further comprising an input biasing circuitry.

6. The stringed instrument of claim 1 further comprising a dual rail power supply.

7. The stringed instrument of claim 1 wherein the direction detector comprises two or more operational amplifiers, the two or more operational amplifiers configured to receive a signal from a pickup and wherein the outputs of the two or more operational amplifiers are combined to form the electrical signal.

* * * * *